US010744779B2

(12) United States Patent
Nagashima et al.

(10) Patent No.: US 10,744,779 B2
(45) **Date of Patent: *Aug. 18, 2020**

(54) BOTTLE SET

(71) Applicant: SEIKO EPSON CORPORATION, Tokyo (JP)

(72) Inventors: Takumi Nagashima, Nagano (JP); Tetsuya Takamoto, Nagano (JP); Hiroyuki Nakamura, Makati (PH); Tadahiro Mizutani, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 16/272,217

(22) Filed: Feb. 11, 2019

(65) Prior Publication Data

US 2019/0168510 A1 Jun. 6, 2019

Related U.S. Application Data

(63) Continuation of application No. 15/604,864, filed on May 25, 2017, now Pat. No. 10,239,323.

(30) Foreign Application Priority Data

May 31, 2016 (JP) ..... 2016-108271

(51) Int. Cl.
*B41J 2/175* (2006.01)
*B65D 41/04* (2006.01)
(Continued)

(52) U.S. Cl.
CPC ..... *B41J 2/1754* (2013.01); *B41J 2/17523* (2013.01); *B41J 2/17553* (2013.01);
(Continued)

(58) Field of Classification Search
CPC .. B41J 2/1754; B41J 2/17523; B41J 2/17553; B65D 41/04
See application file for complete search history.

(56) References Cited

U.S. PATENT DOCUMENTS 6,213,597 B1 4/2001 Liu
10,239,323 B2 * 3/2019 Nagashima ..... B41J 2/1754
(Continued)

FOREIGN PATENT DOCUMENTS

CN 202186122 U 4/2012
JP 2001-002097 A 1/2001
JP 2004-136955 A 5/2004

*Primary Examiner* — Jason S Uhlenhake
(74) *Attorney, Agent, or Firm* — Global IP Counselors, LLP

(57) ABSTRACT

A bottle set includes a bottle and a lid member. The bottle has an ink container, a nozzle and a joint portion integrally formed with the nozzle and having a thread configured to engage the nozzle with the ink container. The lid member is attachable to and detachable from the bottle. An outflow port is formed in the nozzle. The outflow port is configured such that the ink in the ink container flows out from the outflow port. The lid member has a tubular barrel, a top plate that closes a barrel end of the tubular barrel, and a plug projecting from the top plate toward the nozzle. A distance from the barrel end of the tubular barrel to a distal end of the plug being shorter than a distance from a nozzle end of the nozzle to the joint portion.

10 Claims, 19 Drawing Sheets

(51) Int. Cl.
*B65D 47/06* (2006.01)
*B65D 51/18* (2006.01)

(52) U.S. Cl.
CPC ..... *B65D 41/04* (2013.01); *B65D 47/06* (2013.01); *B65D 51/18* (2013.01); *B65D 2251/009* (2013.01); *B65D 2251/0025* (2013.01); *B65D 2251/0028* (2013.01); *B65D 2251/0078* (2013.01)

(56) References Cited

U.S. PATENT DOCUMENTS

| | | | |
|---|---|---|---|
| 2007/0024683 | A1 | 2/2007 | Yan |
| 2012/0125481 | A1 | 5/2012 | Matsumoto et al. |
| 2013/0278685 | A1 | 10/2013 | Nagasawa et al. |

* cited by examiner

BOTTLE SET

CROSS REFERENCE TO RELATED APPLICATIONS

This application is a continuation application of U.S. patent application Ser. No. 15/604,864, filed on May 25, 2017. The present application claims priority from Japanese Patent Application No. 2016-108271 filed on May 31, 2016, the contents of which are hereby incorporated by reference into this application.

BACKGROUND

1. Technical Field

The present invention relates to a bottle set and the like.

2. Related Art

Examples of hitherto known ink ejection apparatuses include inkjet printers capable of printing on a recording medium, such as recording paper, using ink by discharging the ink from a recording head to the recording medium. Some inkjet printers allow a user to refill a tank for storing ink that is to be supplied to the recording head. Bottles with which ink can be injected into a tank are hitherto known (e.g. see Chinese Examined Utility Model Publication No. 202186122).

Chinese Examined Utility Model Publication No. 202186122 discloses a bottle set having a bottle capable of containing ink, and a lid member that is removable from the bottle. In this bottle set, the bottle has a discharge port, which is formed to discharge the contained ink. The lid member in the bottle set covers the discharge port in a state where the lid member is attached to the bottle. In this bottle set, a sealing member for sealing the discharge port is put between the lid member and the discharge port. Thus, the bottle can be sealed with the lid member attached to the bottle. However, in this bottle set, the sealing member is interposed between the lid member and the discharge port. This configuration accordingly makes it difficult to reduce the number of parts of the known bottle set.

SUMMARY

The invention can solve at least the above problem, and may be realized as the following modes or application examples.

A bottle set according to one embodiment includes a bottle and a lid member. The bottle has an ink container configured to contain ink, a nozzle through which the ink in the ink container is configured to flow out, and a joint portion integrally formed with the nozzle and having a thread configured to engage the nozzle with the ink container. The lid member is attachable to and detachable from the bottle, and configured to cover the nozzle in a state where the lid member is attached to the bottle. An outflow port is formed in the nozzle. The outflow port is configured such that the ink in the ink container flows out from the outflow port. The lid member has a tubular barrel, a top plate that closes a barrel end of the tubular barrel, and a plug projecting from the top plate toward the nozzle. A distance from the barrel end of the tubular barrel to a distal end of the plug being shorter than a distance from a nozzle end of the nozzle to the joint portion.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
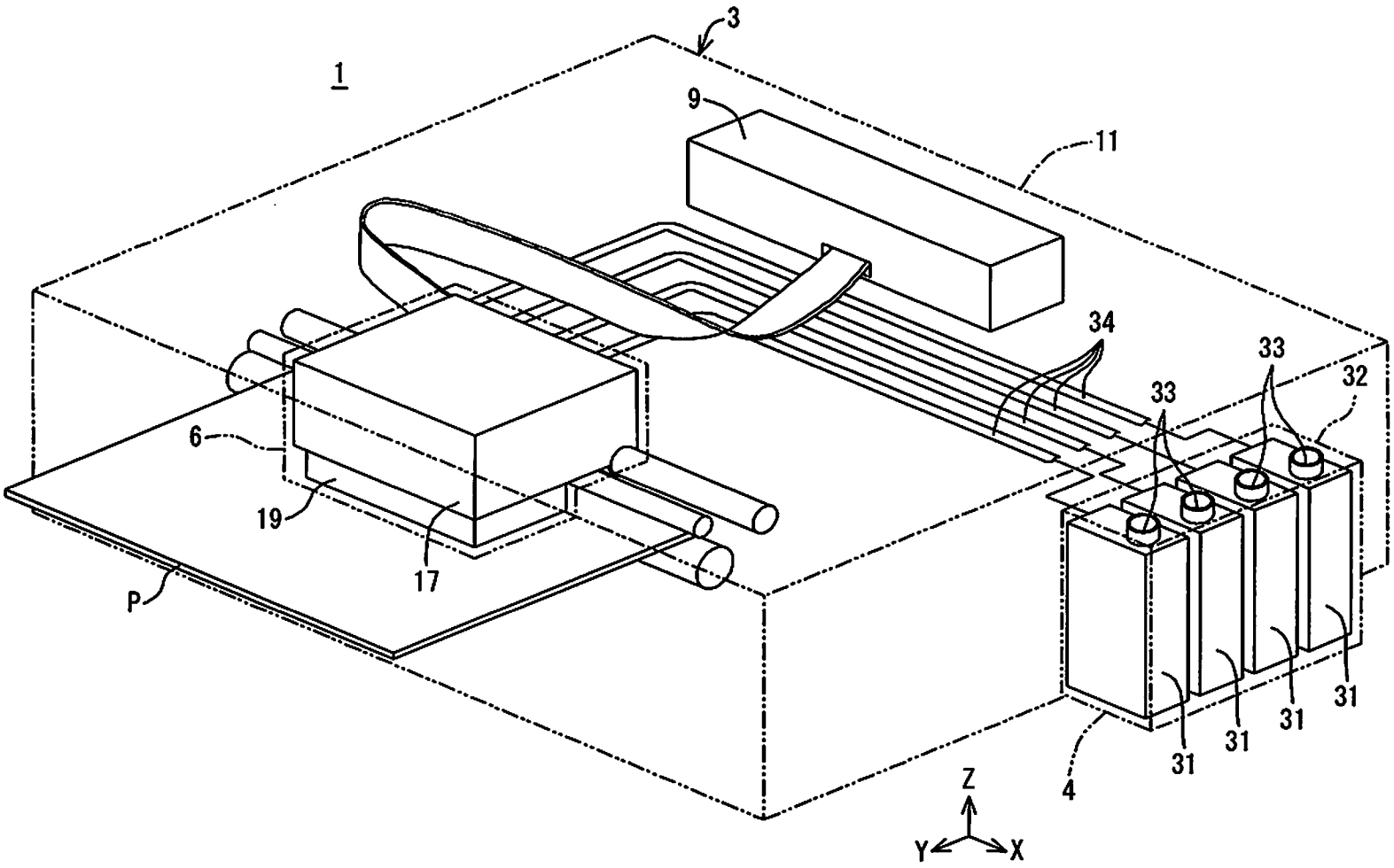
FIG. 1 is a perspective view schematically showing a main configuration of an ink ejection system according to an embodiment.

An embodiment will be described while taking an ink ejection system as an example, with reference to the drawings. Note that, in the drawings, the scale of constituent parts and members may be different such that the respective constituent parts are shown with a recognizable size.

As shown in FIG. 1, an ink ejection system 1 according to this embodiment includes a printer 3, which is an example of an ink ejection apparatus, and an ink supply apparatus 4. The printer 3 has a recorder 6 and a controller 9. Note that X, Y, and Z axes, which are orthogonal coordinate axes, are provided in FIG. 1. The X, Y, and Z axes are also provided as required in the subsequent drawings. In this case, the X, Y, and Z axes in each diagram correspond respectively to the X, Y, and Z axes in FIG. 1. FIG. 1 shows a state where the ink ejection system 1 is disposed on an XY plane defined by the X axis and the Y axis. In this embodiment, the state where the ink ejection system 1 is disposed on the XY plane with the XY plane being matched to a horizontal plane is a use state of the ink ejection system 1. The posture of the ink ejection system 1 when the ink ejection system 1 is disposed on the XY plane that is matched to a horizontal plane will be called a use posture of the ink ejection system 1.

Hereinafter, the X axis, Y axis, and Z axis that appear in the drawings and descriptions depicting constituent parts and units of the ink ejection system 1 mean the X axis, Y axis, and Z axis in a state where the constituent parts and units are assembled with (mounted in) the ink ejection system 1. The posture of the constituent parts and units when the ink ejection system 1 is in the use state will be called a use posture of these constituent parts and units. In the following description, the ink ejection system 1, the constituent parts and units thereof, and the like in their use posture will be described unless otherwise stated.

The Z axis is an axis perpendicular to the XY plane. When the ink ejection system 1 is in the use state, the Z-axis direction is a vertically upward direction. Also, when the ink ejection system 1 is in the use state, the −Z-axis direction is a vertically downward direction in FIG. 1. Note that, regarding the X, V. and Z axes, the arrow orientation indicates a plus (positive) direction, and the orientation opposite to the arrow orientation indicates a minus (negative) direction.

In the printer 3, the recorder 6 and the controller 9 are housed in the housing 11. The recorder 6 performs recording using ink as one example of liquid on a recording medium P, which is conveyed in the Y-axis direction by a conveying apparatus (not shown). Note that the conveying apparatus (not shown) intermittently conveys the recording medium P, such as recording paper, in the Y-axis direction. The recorder 6 is configured to be able to be moved back and forth along the X axis by a moving apparatus (not shown). An ink supply apparatus 4 supplies the ink to the recorder 6. The controller 9 controls driving of the aforementioned constituent parts.

Here, a direction parallel with the X axis is not limited to a direction that is perfectly parallel with the X axis, and also includes a direction that tilts relative to the X axis due to an error, a tolerance, or the like, excluding a direction perpendicular to the X axis. Similarly, a direction parallel with the Y axis is not limited to a direction that is perfectly parallel with the Y axis, and also includes a direction that tilts relative to the Y axis due to an error, a tolerance, or the like, excluding a direction perpendicular to the Y axis. A direction parallel with the Z axis is not limited to a direction that is perfectly parallel with the Z axis, and also includes a direction that tilts relative to the Z axis due to an error, a tolerance, or the like, excluding a direction perpendicular to the Z axis. That is to say, a direction parallel to an axis or a plane is not limited to a direction that is perfectly parallel with this axis or plane, and also includes a direction that tilts relative to this axis or plane due to an error, a tolerance, or the like, excluding a direction perpendicular to this axis or plane.

The recorder 6 includes a carriage 17 and a recording head 19. The recording head 19 is an example of an ink ejector, and discharges droplets of the ink to perform recording on the recording medium P. The recording head 19 is mounted in the carriage 17. Note that the recording head 19 is electrically connected to the controller 9. Discharge of ink droplets from the recording head 19 is controlled by the controller 9.

The ink supply apparatus 4, which is an example of a tank unit, includes tanks 31, each of which is an example of an ink supply unit, as shown in FIG. 1. In this embodiment, the ink supply apparatus 4 has a plurality of (in this embodiment, four) tanks 31. The plurality of tanks 31 are housed in a housing 32. Thus, the tanks 31 can be protected by the housing 32. Note that the housing 32 and the housing 11 may be separate bodies, or may be integrated. In the case where the housing 32 and the housing 11 are integrated, it can be said that the plurality of tanks 31 are housed in the housing 11 together with the recording head 19 and ink supply tubes 34.

The ink is contained in each tank 31. An ink injection portion 33 is formed in each tank 31. The ink can be injected into each tank 31 from outside via the ink injection portion 33. Note that an operator can access the ink injection portion 33 of the tank 31 from outside the housing 32. The ink injection portion 33 is sealed by a lid (not shown). When the ink is injected into each tank 31, a lid is removed to open the ink injection portion 33, and thereafter the ink is injected.

Ink supply tubes 34 are connected to the respective tanks 31. The ink in each tank 31 is supplied to the recording head 19 from the ink supply apparatus 4 via the corresponding ink supply tube 34. The ink supplied to the recording head 19 is discharged as ink droplets from nozzles (not shown), which are oriented toward the recording medium P side. Note that, although the above example describes the printer 3 and the ink supply apparatus 4 as separate constituent parts, the ink supply apparatus 4 may be included in the constituent parts of the printer 3.

In the ink ejection system 1 having the above configuration, recording is performed onto the recording medium P by conveying the recording medium P in the Y-axis direction, and causing the recording head 19 to discharge ink droplets at a given position while moving the carriage 17 back and forth along the X axis. This operation is controlled by the controller 9.

The ink is not limited to either one of water-based ink or oil-based ink. Water-based ink may be either ink having a configuration in which a solute, such as a dye, is dissolved in a water-based solvent, or ink having a configuration in which a dispersoid, such as a pigment, is dispersed in a water-based dispersing medium. Oil-based ink may be either ink having a configuration in which a solute, such as a dye, is dissolved in an oil-based solvent, or ink having a configuration in which a dispersoid, such as a pigment, is dispersed in an oil-based dispersing medium.

Figure 2:
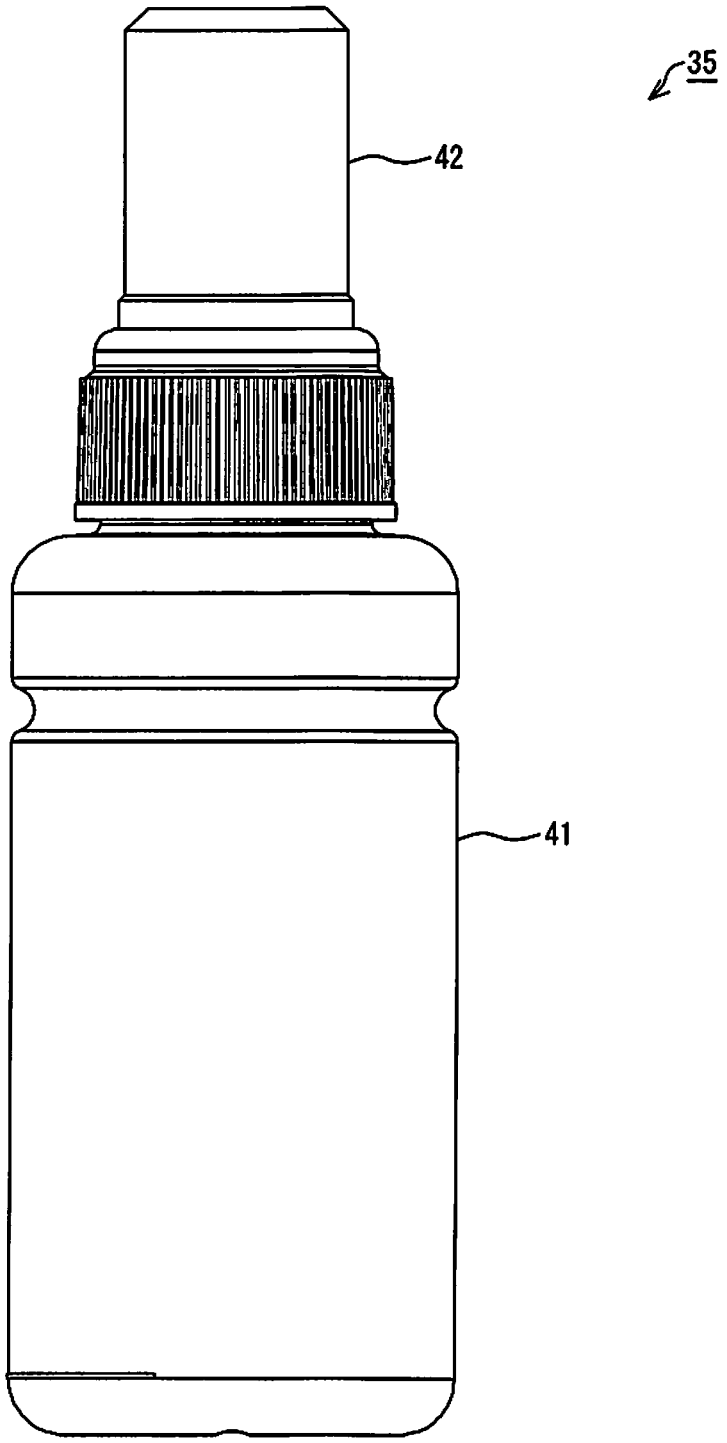
FIG. 2 is an external view of a bottle set according to an embodiment.
Figure 3:
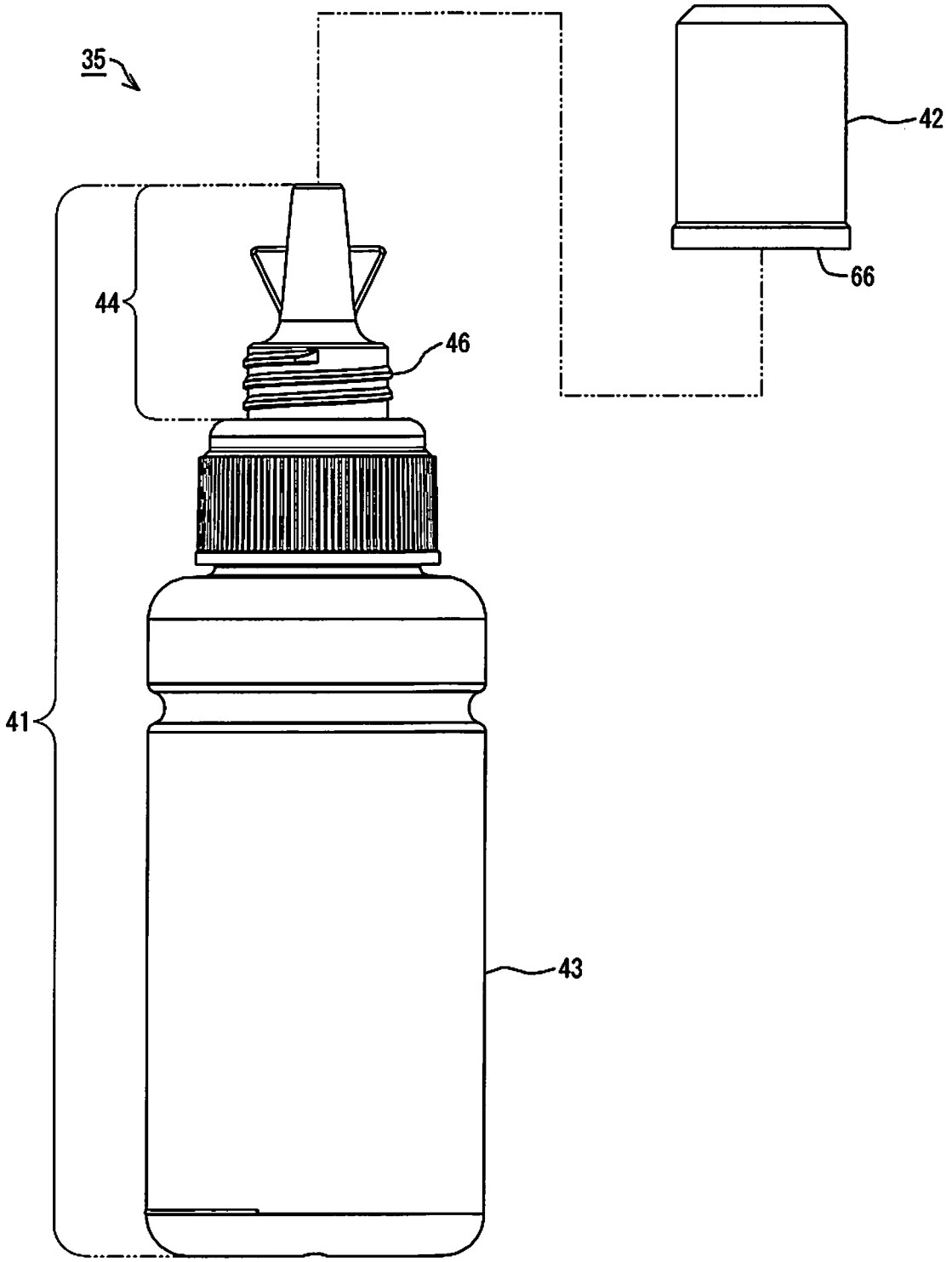
FIG. 3 is an exploded view of the bottle set according to an embodiment.

In this embodiment, a bottle set 35 shown in FIG. 2 may be utilized to inject the ink into the tanks 31. The ink to be injected into one of the tanks 31 is contained in the bottle set 35. The bottle set 35 includes a bottle 41 and a lid member 42. The lid member 42 is configured to be removable from the bottle 41, as shown in FIG. 3. The bottle 41 includes an ink container 43 and a nozzle 44. The ink container 43 is a portion capable of containing the ink. The nozzle 44 is a portion from which the ink in the ink container 43 can flow out of the bottle 41.

The lid member 42, when in a state of being attached to the bottle 41, is configured to be able to cover the nozzle 44. The nozzle 44 can also be defined as a portion that is covered by the lid member 42 when the lid member 42 is attached to the bottle 41. A later-described outflow port is formed in the nozzle 44. The ink in the ink container 43 flows out of the bottle 41 from the outflow port in the nozzle 44. The lid member 42, when in a state of being attached to the bottle 41, covers the outflow port in the nozzle 44.

Note that the lid member 42 may be engaged with the nozzle 44 via a thread 46 formed on the nozzle 44, as shown in FIG. 3. That is to say, in this embodiment, the lid member 42 is configured to be able to be attached to the bottle 41 through engagement therebetween via the thread 46. Note that the lid member 42 has a later-described thread, which is formed to be capable of engaging with the thread 46 on the nozzle 44. As a result of the thread in the lid member 42 engaging with the thread 46 on the nozzle 44, the lid member 42 may be attached to the bottle 41.

Figure 4:
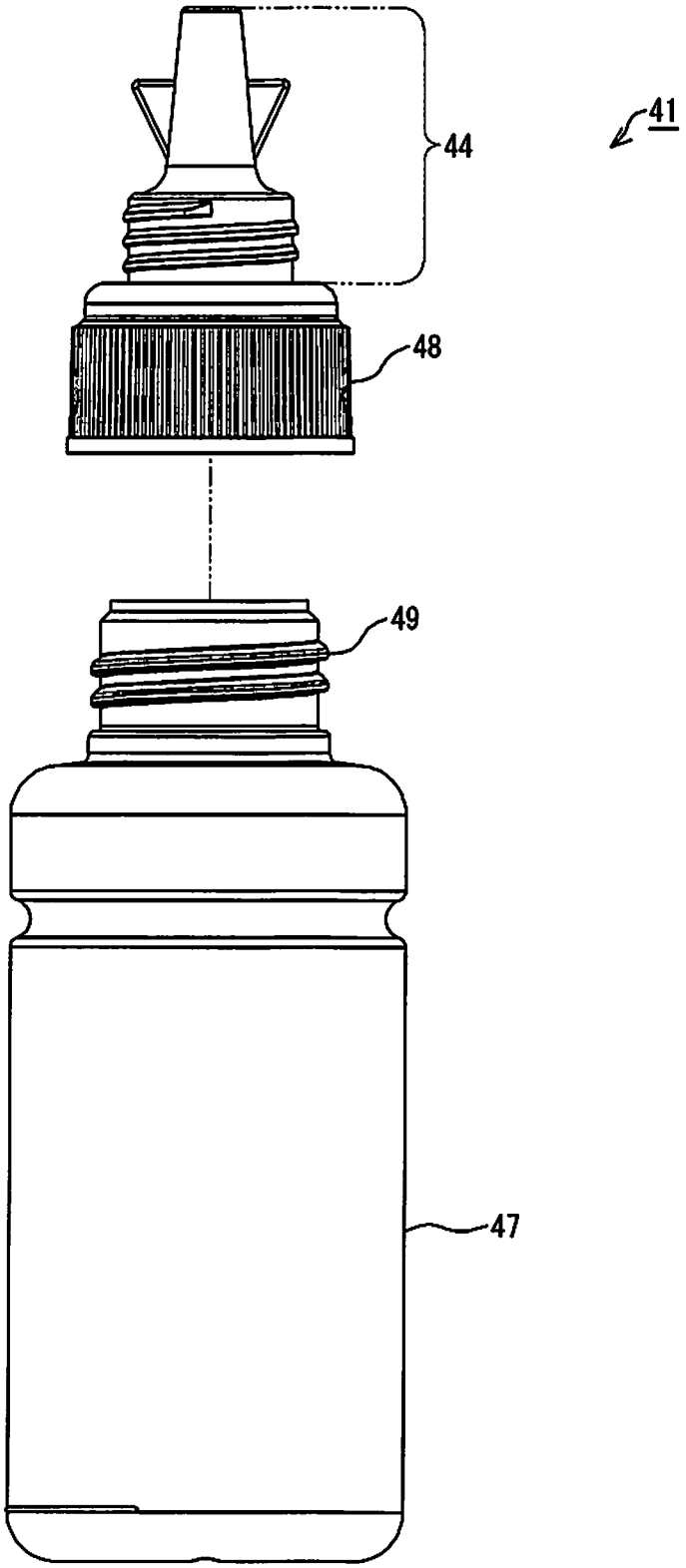
FIG. 4 is an exploded view of a bottle according to an embodiment.

In this embodiment, the bottle 41 includes a container member 47 and a nozzle member 48, as shown in FIG. 4. In this embodiment, the bottle 41 is configured by integrally combining the container member 47 with the nozzle member 48 to form one body. The container member 47 and the nozzle member 48 are combined to form one bottle 41 through engagement therebetween via a thread 49. Note that the nozzle member 48 has a later-described thread, which is formed to be capable of engaging with the thread 49 on the container member 47. As a result of the thread in the nozzle member 48 engaging with the thread 49 on the container member 47, the container member 47 and the nozzle member 48 are combined to form one bottle 41.

Note that the number of parts to constitute the bottle 41 is not limited to two, namely the container member 47 and the nozzle member 48. The number of parts to constitute the bottle 41 may be three or more. Also, the number of parts to constitute the bottle 41 may be one. When the bottle 41 is constituted by one part, this part can be formed by integrally molding resin, for example.

Various examples of the bottle set 35 and members that constitute the bottle set 35 (hereinafter referred to as constituent members) will be described. Note that, in the following description, different alphabetical characters, symbols, or the like will be appended to the signs of the bottle set 35 and the constituent members in the respective examples in order to identify the bottle set 35 and the constituent members in the respective examples.

Example 1

Figure 5:
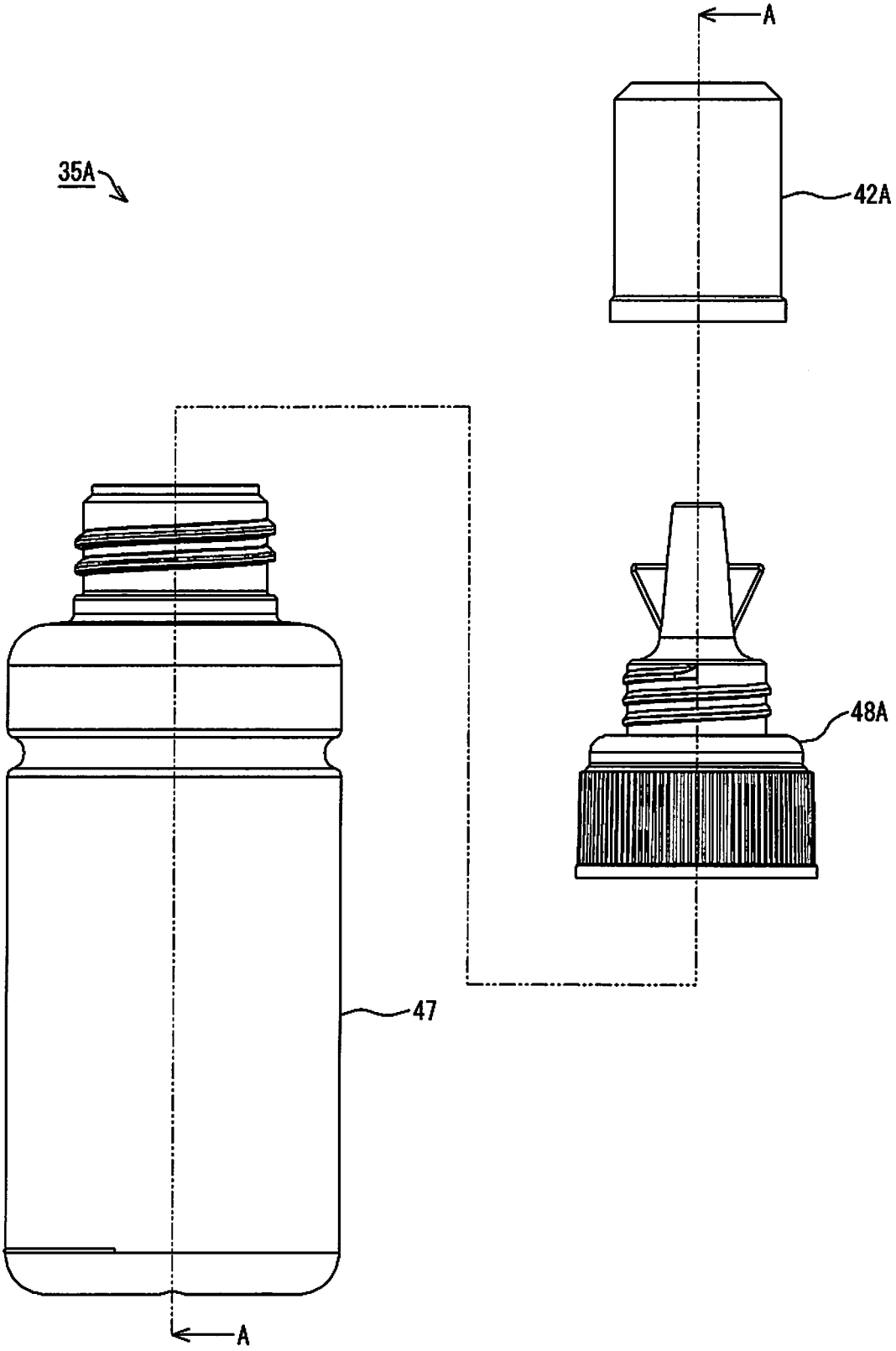
FIG. 5 is an exploded view of a bottle set in Example 1.
Figure 6:
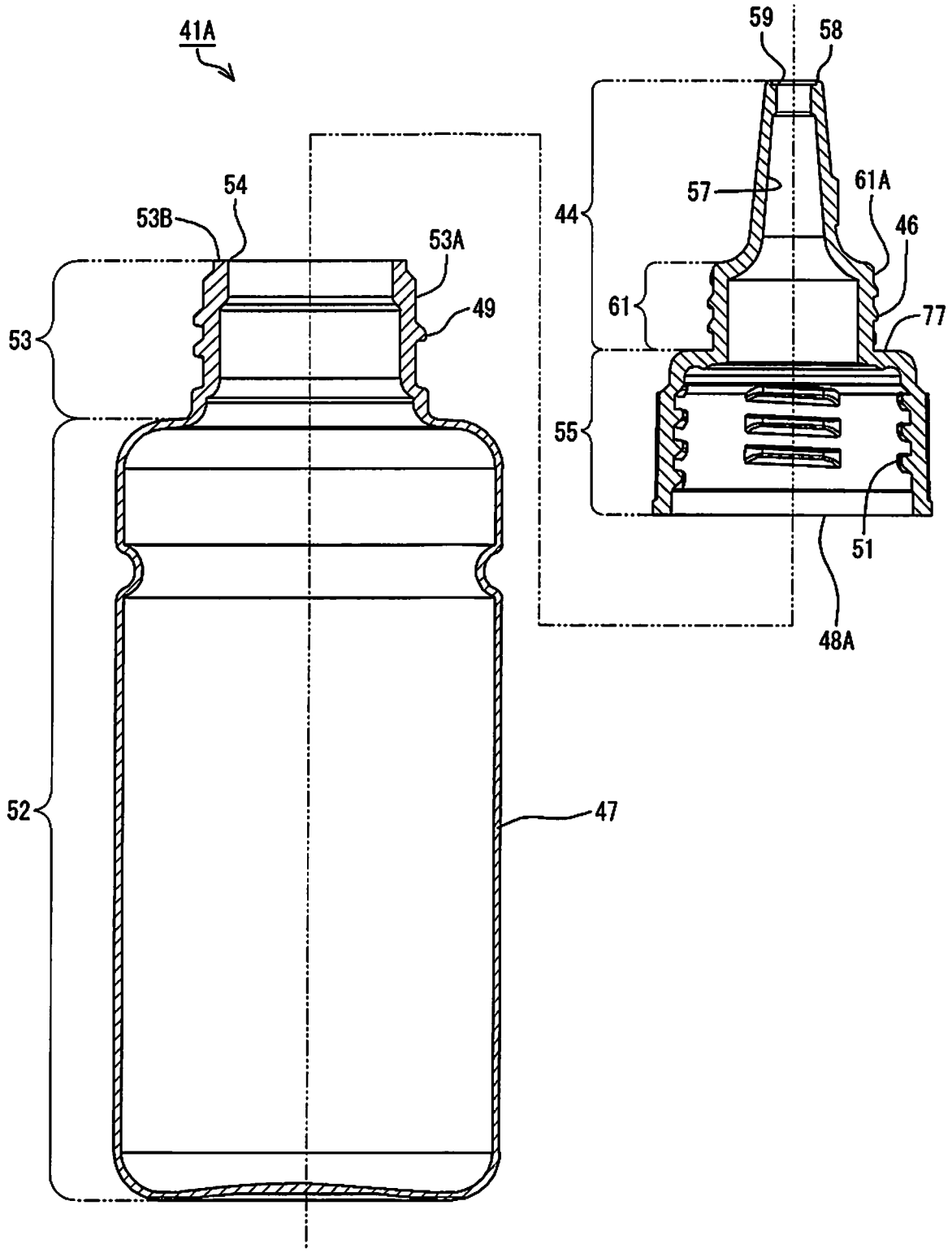
FIG. 6 is a cross-sectional view of a container member and a nozzle member in Example 1.

A bottle set 35A in Example 1 includes a container member 47, a nozzle member 48A, and a lid member 42A, as shown in FIG. 5. In the bottle set 35A, the container member 47 and the nozzle member 48A constitute the bottle 41A, as shown in FIG. 6. Note that FIG. 6 shows a cross-section of the bottle 41A in Example 1 taken along a line A-A in FIG. 5.

The container member 47 is configured to be able to contain the ink. The container member 47 and the nozzle member 48A are configured to be separate bodies. A thread 51 is formed in the nozzle member 48A. The container member 47 and the nozzle member 48A are configured to be engageable with each other using the thread 49 on the container member 47 and the thread 51 in the nozzle member 48A. The container member 47 and the nozzle member 48A are also configured to be attachable to and detachable from each other. By relatively twisting (turning) the nozzle member 48A with respect to the container member 47, the nozzle member 48A can be removed from the container member 47.

The ink is contained in the container member 47. The container member 47 is made of an elastic material. As shown in FIG. 6, the container member 47 has a tubular barrel 52, a tubular engaging portion 53, and an opening 54. The material of the container member 47 may be resin such as polyethylene terephthalate (PET), nylon, polyethylene, polypropylene, or polystyrene, for example. The barrel 52 and the engaging portion 53 are integrally formed. The barrel 52 is located on the side opposite to the nozzle member 48A side with respect to the engaging portion 53. The engaging portion 53 is located on the nozzle member 48A side with respect to the barrel 52. The engaging portion 53 is formed to have a smaller diameter than that of the barrel 52. The thread 49 is formed in an outer side portion 53A of the engaging portion 53. The thread 49 is provided so as to project from the side portion 53A. The opening 54 is formed at an end 53B of the engaging portion 53 on the side opposite to the barrel 52 side. The opening 54 is open toward the nozzle member 48A side.

The nozzle member 48A may be divided into a joint portion 55 and the nozzle 44, as shown in FIG. 6. The joint portion 55 and the nozzle 44 are integrally formed. The material of the nozzle member 48A may be resin such as polyethylene terephthalate (PET), nylon, polyethylene, polypropylene, or polystyrene, for example. The joint portion 55 has a tubular appearance. The thread 51 is provided in an inner side face of the joint portion 55. The joint portion 55 is a part to be engaged with the container member 47 using the thread 51. The inner diameter of the joint portion 55 is configured to be wider than the outer diameter of the engaging portion 53 of the container member 47. The thread 51 is formed inside the joint portion 55, and the thread 49 is formed outside the engaging portion 53 of the container member 47. As a result of the thread 51 provided inside the joint portion 55 engaging with the thread 49 provided outside the engaging portion 53, the nozzle member 48 and the container member 47 engage with each other. In a state where the nozzle member 48A and the container member 47 engage with each other, the joint portion 55 of the nozzle member 48A covers the engaging portion 53 of the container member 47.

The nozzle 44 projects from the joint portion 55 to the side opposite to the container member 47 side. The nozzle 44 has a pipe-like shape. A guiding flow passage 57 is formed inside the nozzle 44. The guiding flow passage 57 is provided in an area that overlaps the area of the opening 54 when seen in a plan view. The guiding flow passage 57 is a hollow area in the nozzle 44, the area overlapping the area of the opening 54 when seen in a plan view. An outflow port 59 is formed at an end 58 of the nozzle 44 on the side opposite to the joint portion 55 side. The outflow port 59 is open toward the side opposite to the joint portion 55 side in the nozzle 44. The outflow port 59 is open at the end 58. Thus, the end 58 surrounds the outflow port 59. The outflow port 59 is located at a terminal of the guiding flow passage 57.

The ink contained in the container member 47 can flow out from the outflow port 59 through the guiding flow passage 57 in the nozzle 44. As a result, the ink in the container member 47 may flow out of the container member 47 from the outflow port 59 through the opening 54 and the guiding flow passage 57. When a user injects the ink in the bottle 41A into the corresponding tank 31, the outflow port 59 is inserted into the ink injection portion 33 of the tank 31. The user then injects the ink in the container member 47 into the tank 31 from the ink injection portion 33. Note that, when the user injects the ink in the bottle 41A into the tank 31, the user removes the lid member 42A (FIG. 5) from the bottle 41A and thereafter performs the injecting operation.

The nozzle 44 includes an engaging portion 61, as shown in FIG. 6. The engaging portion 61 has a tubular appearance, and is located on the joint portion 55 side in the nozzle 44. The engaging portion 61 is formed to have a smaller diameter than that of the joint portion 55. The thread 46 is formed in an outer side portion 61A of the engaging portion 61. The thread 46 is provided so as to project from the side portion 61A. A portion of the nozzle 44 on the side opposite to the joint portion 55 side with respect to the engaging portion 61 is formed to have a smaller diameter than that of the engaging portion 61. Note that, in this example, the guiding flow passage 57 becomes narrower toward the outflow port 59.

Figure 7:
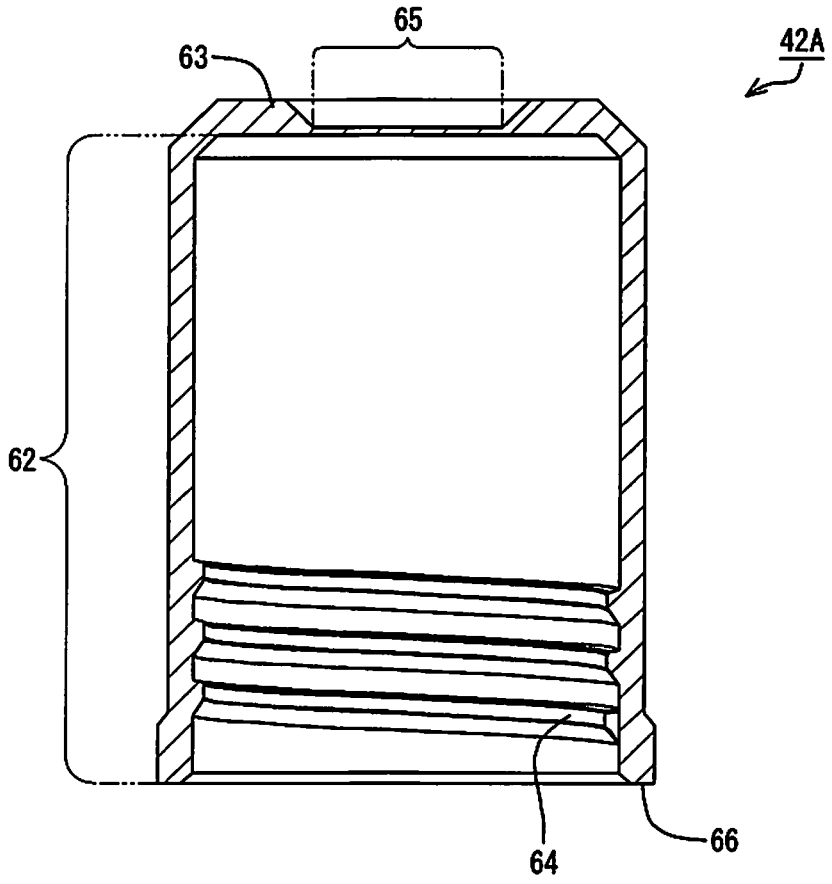
FIG. 7 is a cross-sectional view of a lid member in Example 1.

The lid member 42A is made of an elastic material, and may be divided into a tubular barrel 62 and a plate-shaped top plate 63, as shown in FIG. 7, which is a cross-sectional view. Note that FIG. 7 shows a cross-section of the lid member 42A taken along the line A-A in FIG. 5. The material of the lid member 42A may be resin such as polyethylene terephthalate (PET), nylon, polyethylene, polypropylene, or polystyrene, for example. In this example, the lid member 42A is formed by injection molding using a resin material.

The barrel 62 and the top plate 63 are integrally formed. In the bottle set 35A (FIG. 5), the barrel 62 of the lid member 42A is located on the nozzle member 48A side. The top plate 63 is located at one end of the barrel 62. In this example, the top plate 63 is located on the side opposite to the nozzle member 48A side with respect to the barrel 62. The top plate 63 closes one end of the tubular barrel 62.

A thread 64 is provided in an inner side face of the barrel 62. The barrel 62 is a part to be engaged with the nozzle member 48A (FIG. 6) using the thread 64. The inner diameter of the barrel 62 is configured to be wider than the outer diameter of the engaging portion 61 of the nozzle member 48A. The thread 64 is formed inside the barrel 62, and the thread 46 is formed outside the engaging portion 61 of the nozzle member 48A. As a result of the thread 64 provided inside the barrel 62 engaging with the thread 46 provided outside the engaging portion 61 of the nozzle member 48A, the lid member 42A and the nozzle member 48A engage with each other. In a state where the lid member 42A and the nozzle member 48A engage with each other, the lid member 42A covers the nozzle 44 in the nozzle member 48A. For this reason, in this example, it can also be defined that, the portion of the nozzle member 48A on the side opposite to the joint portion 55 with respect to the thread 46 is the nozzle 44.

Here, an abutting portion 65 is provided in the top plate 63 of the lid member 42A, as shown in FIG. 7. The abutting portion 65 is provided in a center area of the top plate 63. The abutting portion 65 is formed to be thinner than the thickness of the other part of the lid member 42A. As mentioned above, the barrel 62 and the top plate 63 are integrally formed. Thus, the abutting portion 65 is also integrally formed in the top plate 63. The abutting portion 65 is an area against which the end 58 (FIG. 6) of the nozzle 44 can abut when the lid member 42A is attached to the bottle 41A.

Figure 8:
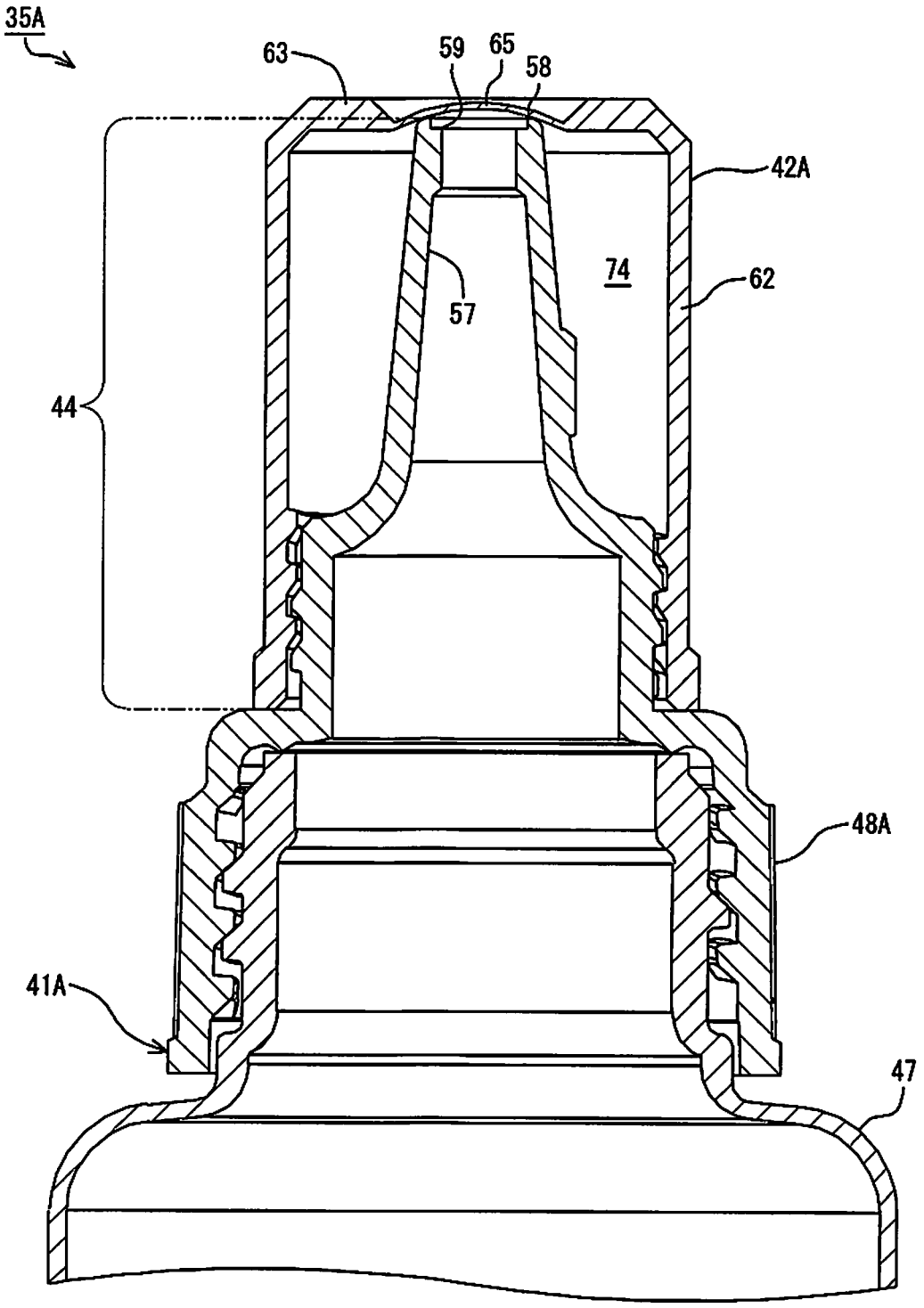
FIG. 8 is a cross-sectional view of the bottle set in Example 1.

In this example, the distance (depth) from an end 66 of the barrel 62 to the top plate 63 is shorter (shallower) than the distance from the joint portion 55 to the end 58 of the nozzle member 48A (FIG. 6). That is to say, the end 58 of the nozzle 44 is set to abut against the abutting portion 65 of the lid member 42A when the lid member 42A is attached to the bottle 41A, as shown in FIG. 8. Thus, when the lid member 42A is attached to the bottle 41A, the periphery of the outflow port 59 of the nozzle 44 abuts against the abutting portion 65.

With this configuration, the outflow port 59 can be sealed. Thus, in the case where, for example, the ink in the container member 47 cannot be entirely injected into the tank 31 and some ink remains in the container member 47, the ink can be stored in the bottle 41A with the outflow port 59 closed by the lid member 42A. This configuration allows the ink to be stored with an increased airtightness in the container member 47 after being opened. As a result, it is possible to suppress evaporation of liquid components of the ink in the bottle 41A and degradation of the ink. Note that the abutting portion 65 is an example of a sealing portion. In this example, the abutting portion 65 for sealing the outflow port 59 of the nozzle 44 is integrally formed in the lid member 42A. Thus, in this bottle set 35A, the outflow port 59 in the nozzle 44 can be sealed with the lid member 42A. With this configuration, the number of parts can be reduced compared with a configuration in which the outflow port 59 is sealed by adding other members to the lid member 42A.

Furthermore, in this example, the thickness of the abutting portion 65 is formed to be smaller than the thickness of the other part of the lid member 42A. Thus, as shown in FIG. 8, the abutting portion 65 readily undergoes elastic deformation when the lid member 42A is attached to the bottle 41A. With this configuration, the abutting portion 65 and the periphery of the outflow port 59 are readily fitted closely to each other, which further facilitates increasing the airtightness at the outflow port 59.

Example 2

Figure 9:
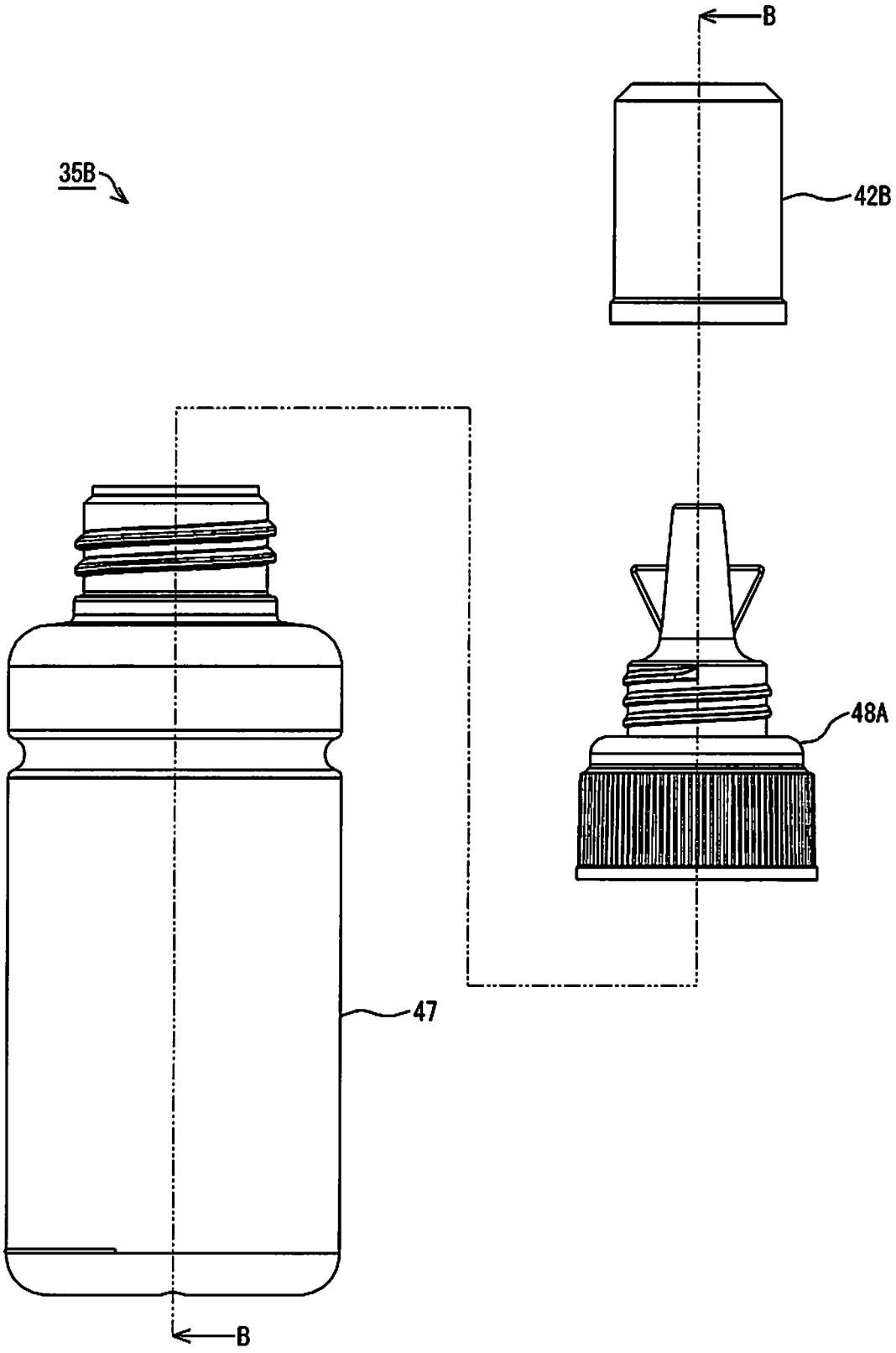
FIG. 9 is an exploded view of a bottle set in Example 2.

A bottle set 35B in Example 2 includes a container member 47, a nozzle member 48A, and a lid member 42B, as shown in FIG. 9. The bottle set 35 has the same configuration as that in Example 1, except that the lid member 42A in the bottle set 35A in Example 1 is replaced with the lid member 42B. That is to say, the container member 47 and the nozzle member 48A in the bottle set 35B in Example 2 are identical to those in Example 1. Accordingly, constituent parts in Example 2 that are the same as those in Example 1 will be assigned the same signs as those in Example 1, and a detailed description thereof will be omitted.

Figure 10:
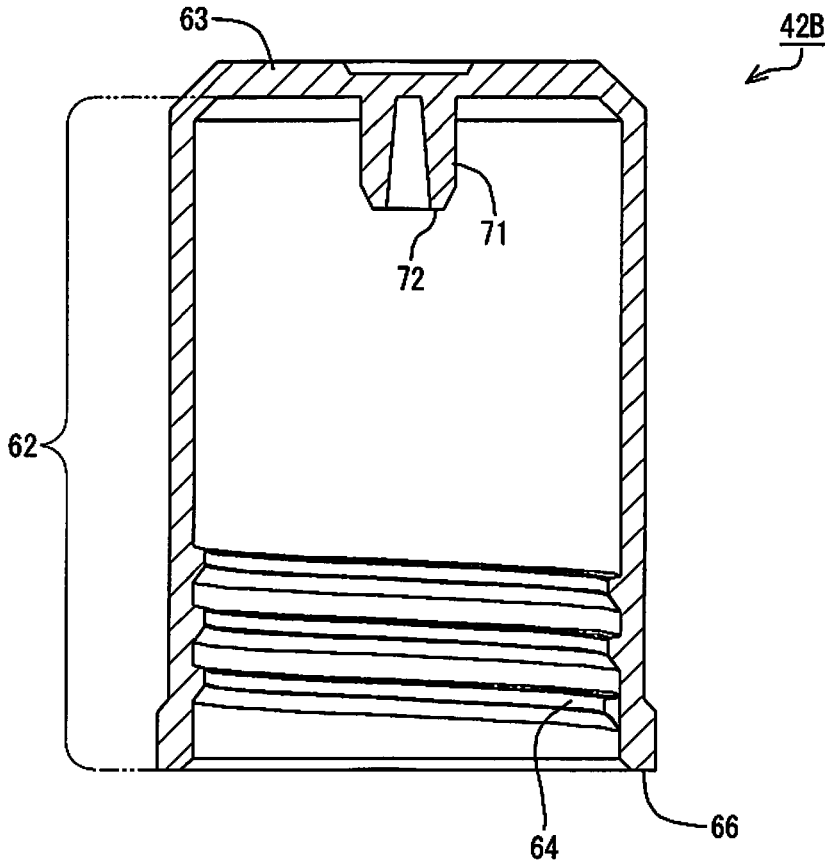
FIG. 10 is a cross-sectional view of a lid member in Example 2.

The lid member 42B may be divided into a barrel 62 and a top plate 63 similarly to the lid member 42A in Example 1, as shown in FIG. 10, which is a cross-sectional view. Note that FIG. 10 shows a cross-section of the lid member 42B taken along a line B-B in FIG. 9. In the lid member 42B, the abutting portion 65 in Example 1 is omitted from the top plate 63. That is to say, the lid member 42B does not have the abutting portion 65. Also, in the lid member 42B, a plug 71 is provided in the top plate 63. In the lid member 42B, the abutting portion 65 is omitted from the lid member 42A in Example 1, and the plug 71 is added thereto. Except for this, the lid member 42B has the same configuration as that of the lid member 42A.

The plug 71 is an example of a sealing portion, and is provided in the top plate 63 on the nozzle member 48A (FIG. 9) side. The plug 71 projects from the top plate 63 toward the nozzle member 48A (FIG. 9) side. The plug 71 is provided in a center area of the top plate 63. When the lid member 42B is attached to the bottle 41A, the plug 71 is provided at a position opposing the outflow port 59 of the nozzle 44.

Figure 11:
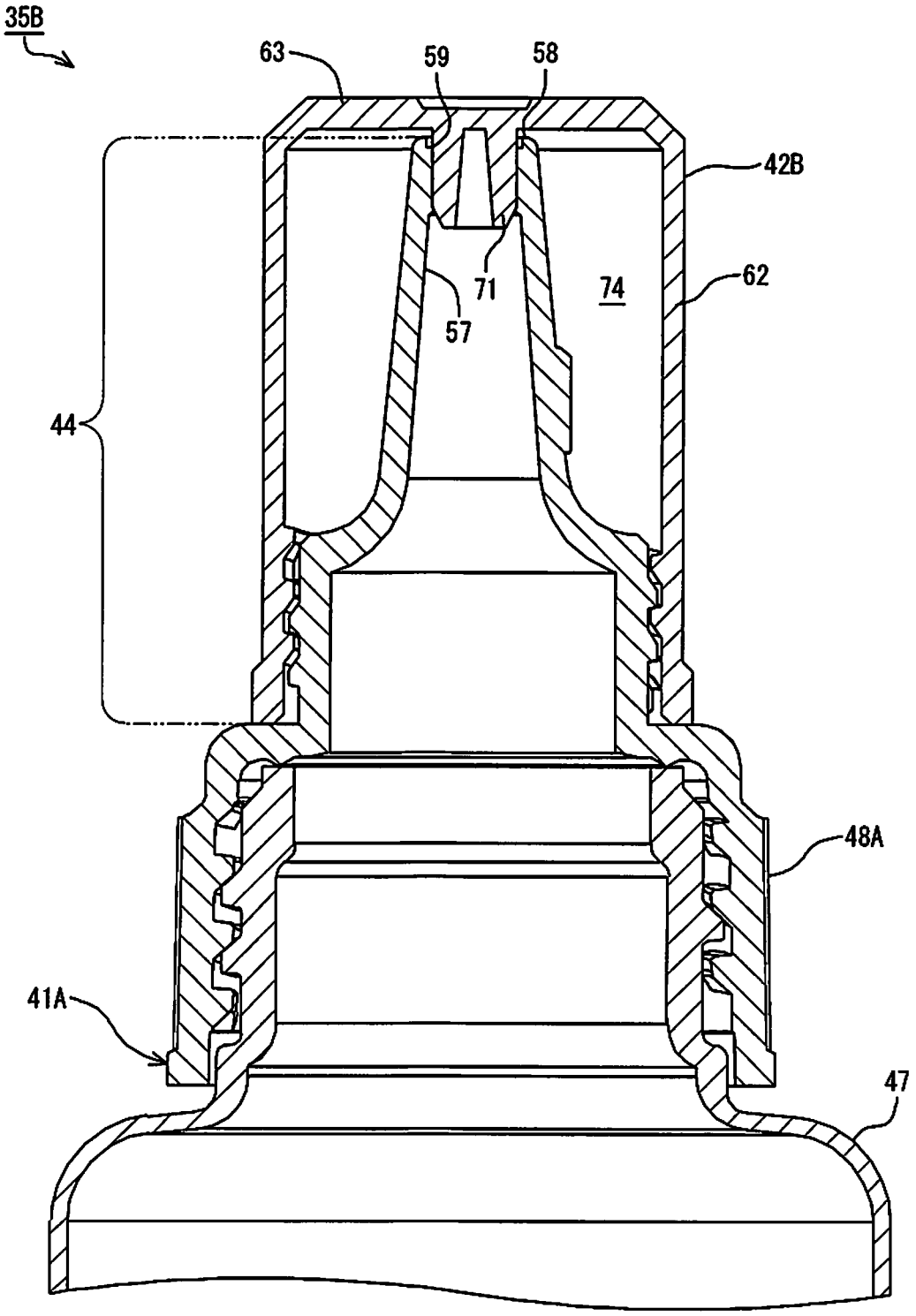
FIG. 11 is a cross-sectional view of the bottle set in Example 2.

In this example, as shown in FIG. 10, the distance (depth) from the open side end 66 of the barrel 62 to an end 72 of plug 71 is shorter (shallower) than the distance from the end 77, the boundary with the joint portion 55, to the end 58 formed with the outflow port 59 of the nozzle member 48A (FIG. 6). That is to say, the plug 71 is set to enter the guiding flow passage 57 from the outflow port 59 when the lid member 42B is attached to the bottle 41A, as shown in FIG. 11. The outer diameter of the plug 71 is greater than the inner diameter of the outflow port 59. For this reason, when the lid member 42B is attached to the bottle 41A, the outflow port 59 of the nozzle 44 is closed by the plug 71.

This configuration enables the outflow port 59 to be sealed. Thus, in the case where, for example, the ink in the container member 47 cannot be entirely injected into the tank 31 and some ink remains in the container member 47, the ink can be stored in the bottle 41A with the outflow port 59 closed by the lid member 42B. Thus, the ink can be stored with an increased airtightness in the container member 47 after being opened. As a result, it is possible to suppress evaporation of liquid components of the ink in the bottle 41A and degradation of the ink. In this example, the plug 71 for sealing the outflow port 59 of the nozzle 44 is integrally formed in the lid member 42B. Thus, in this bottle set 35B, the outflow port 59 in the nozzle 44 can be sealed with the lid member 42B. As a result, the number of parts can be reduced compared with a configuration in which the outflow port 59 is sealed by adding other members to the lid member 42B. As shown in FIG. 11, when the lid member 42B is attached to the nozzle 44 in such a manner that the open side end 66 comes into contact with the end 77, the boundary with the joint portion 55 of the nozzle 44, the plug 71 seals the outflow port 59. As a result, an user is able to recognize that the lid member 42B is completely attached to the nozzle 44.

Example 3

Figure 12:
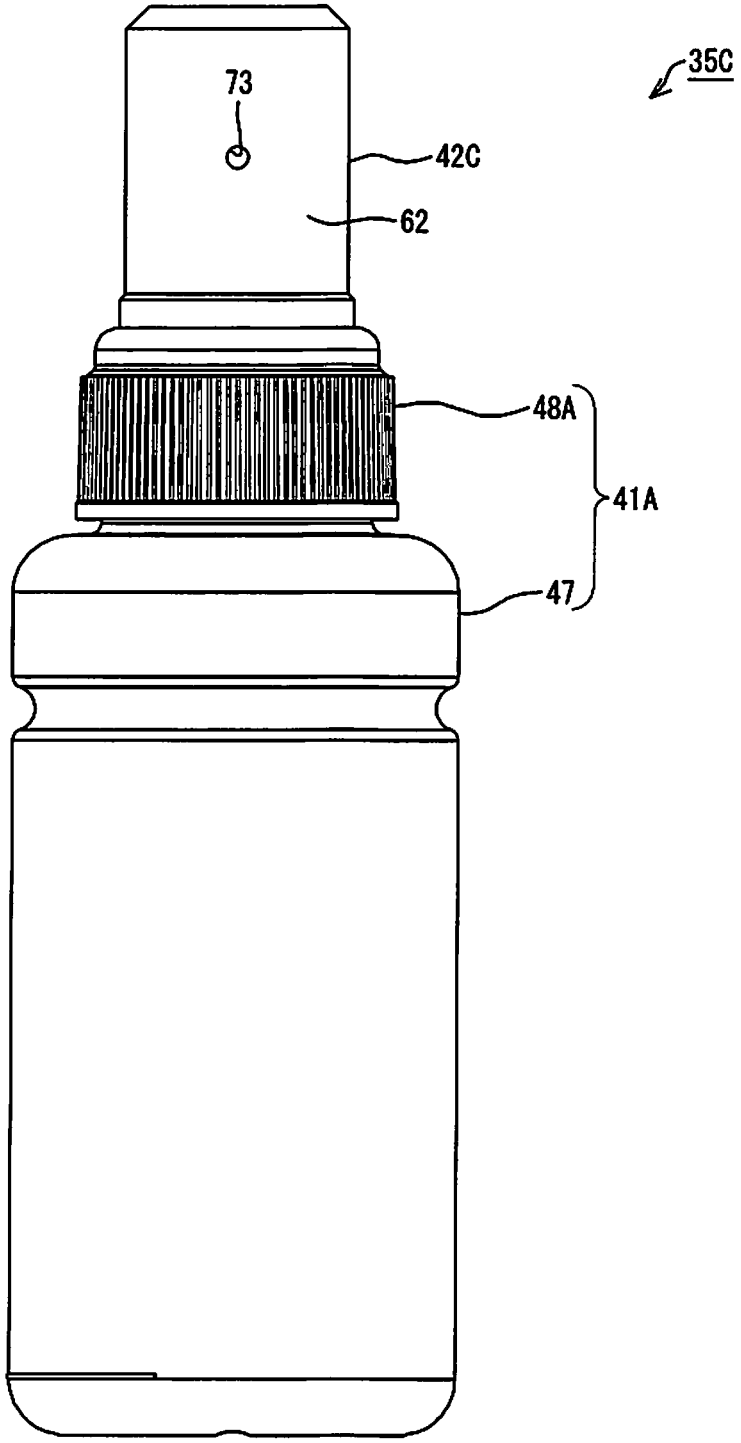
FIG. 12 is an external view of a bottle set in Example 3.

A bottle set 35C in Example 3 includes a lid member 42C and a bottle 41A, as shown in FIG. 12. A communicating hole 73 is formed in the lid member 42C in Example 3. The communicating hole 73 is formed in the barrel 62 of the lid member 42C. The communicating hole 73 passes through the barrel 62. Thus, the inside and the outside of the lid member 42 shown in FIG. 2 are in communication with each other via the communicating hole 73. Accordingly, the communicating hole 73 is an example of a communicating portion capable of bringing the inside and the outside of the lid member 42 into communication with each other. The inside of the lid member 42 is a space to be closed by the lid member 42 and the bottle 41 with the lid member 42 attached to the bottle 41.

In Example 1, the inside of the lid member 42A is a space 74 to be closed by the lid member 42A and the nozzle member 48A, as shown in FIG. 8. In Example 2 as well, the space 74 to be closed by the lid member 42B and the nozzle member 48A is formed, as shown in FIG. 11. The lid member 42C is applicable to both the lid member 42A and the lid member 42B. That is to say, both the configuration in which the communicating hole 73 is formed in the lid member 42A and the configuration in which the communicating hole 73 is formed in the lid member 42B correspond to the lid member 42C. The communicating hole 73 allows the air in the space 74 to be readily released.

In Examples 1 and 2, the space 74 tends to be highly airtight. When the space 74 is highly airtight, the pressure in the space 74 easily changes due to a change in the environment temperature, the atmospheric pressure, or the like. If the pressure in the space 74 changes, the lid member 42 easily deforms, for example. If the lid member 42 deforms, it is conceivable that the lid member 42 easily comes off the bottle 41 or easily gets damaged. If the lid member 42A in Example 1 deforms, the adhesion between the abutting portion 65 and the end 58 of the nozzle 44 degrades, and the ink easily leaks out from the nozzle 44, for example. If the lid member 42B in Example 2 deforms, a gap is easily formed between the plug 71 and the outflow port 59, and the ink easily leaks out from the nozzle 44.

In Example 3, the communicating hole 73 is formed in the barrel 62, which facilitates mitigation of a change in the pressure in the space 74. Thus, deformation of the lid member 42 can be suppressed. As a result, leakage of the ink from the nozzle 44 can be suppressed.

Example 4

Figure 13:
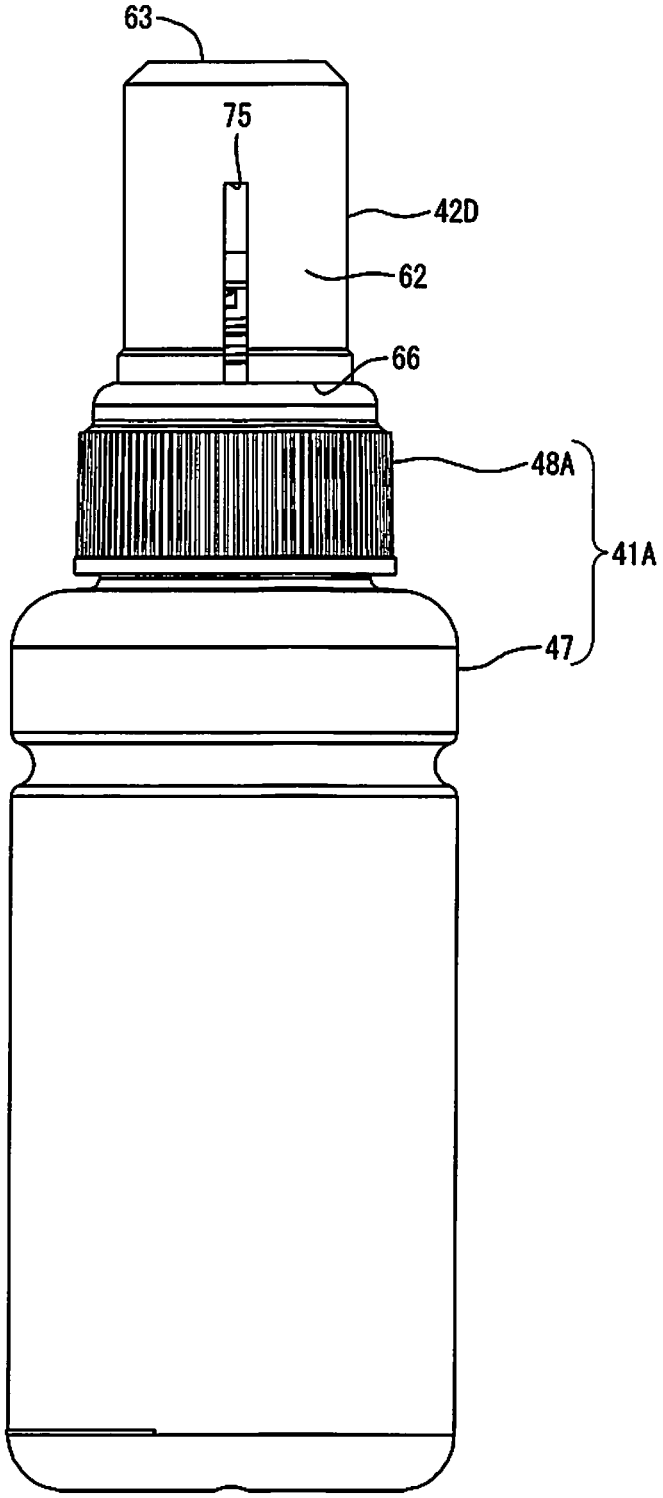
FIG. 13 is an external view of a bottle set in Example 4.

Example 3 employs a configuration in which the air in the space 74 can be released by the lid member 42C in which the communicating hole 73 is formed. However, the configuration that enables the air in the space 74 to be released is not limited thereto. The communicating portion capable of bringing the inside and the outside of the lid member 42 into communication with each other may also be a lid member 42D in which a slit 75 is formed in the barrel 62, as shown in FIG. 13, for example. The lid member 42D in which the slit 75 is formed will now be described as Example 4. In Example 4, constituent parts that are the same as those in Examples 1 to 3 will be assigned the same signs as those in Examples 1 to 3, and a detailed description thereof will be omitted.

The slit 75 is formed to extend from the end 66 of the barrel 62 toward the top plate 63, and passes through the barrel 62. The slit 75 has a shape formed by cutting out the barrel 62 from the end 66 toward the top plate 63. In the lid member 42D in Example 4, the slit 75 allows the air in the space 74 to be readily released. Example 4 can also achieve the same effects as those achieved by Example 3. Note that the slit 75 in Example 4 is applicable to both the lid member 42A and the lid member 42B. Furthermore, the slit 75 is also applicable to the lid member 42C in Example 3.

Example 5

Figure 14:
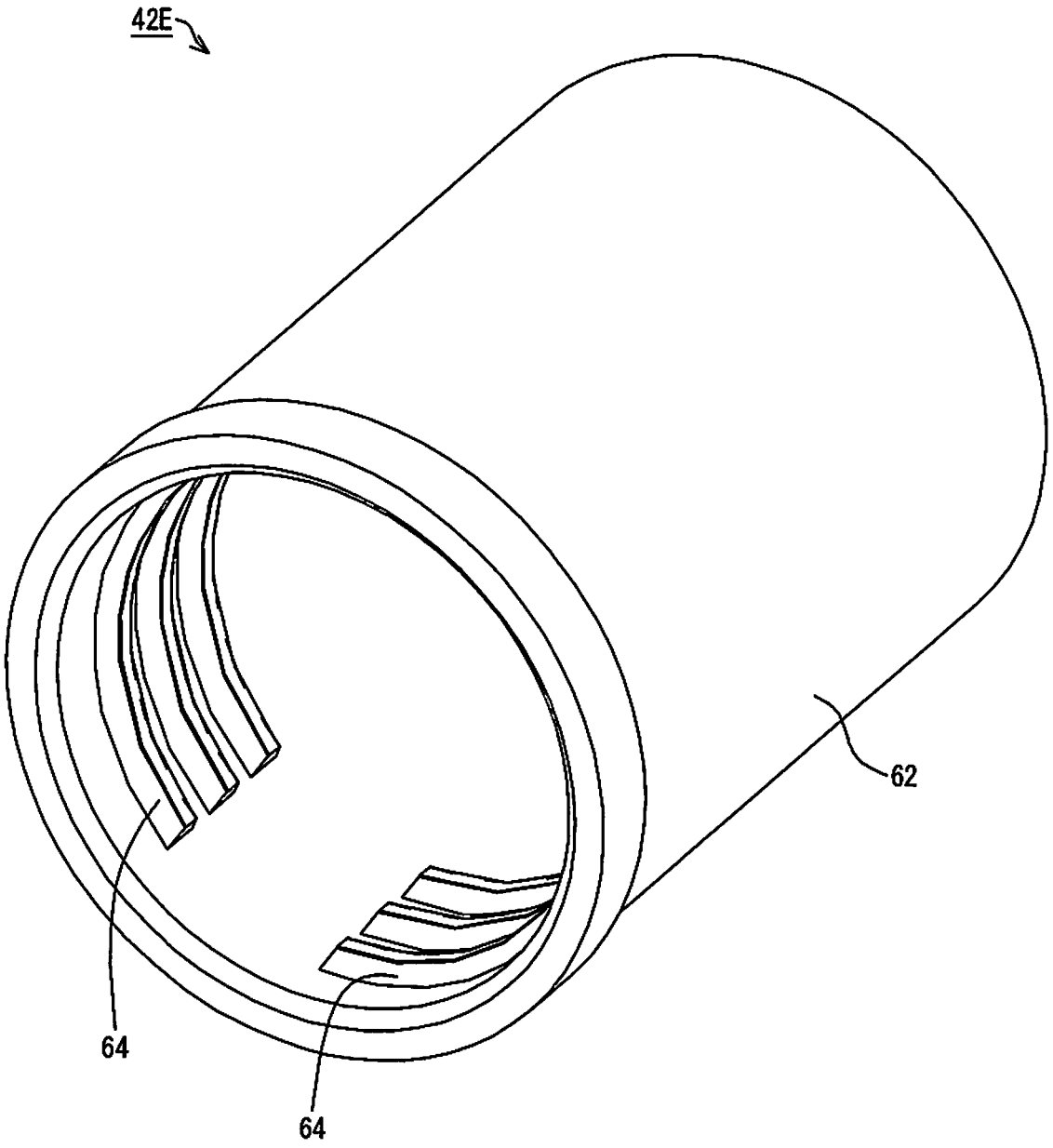
FIG. 14 is a perspective view of a lid member in Example 5.

The communicating portion capable of bringing the inside and the outside of the lid member 42 into communication with each other may also have a shape formed by cutting out a portion of the thread 64 provided in the inner side face of the barrel 62, as shown in FIG. 14, for example. A lid member 42 in which a portion of the thread 64 is cut out will now be described as a lid member 42E in Example 5. In Example 5, constituent parts that are the same as those in Examples 1 to 4 will be assigned the same signs as those in Examples 1 to 4, and a detailed description thereof will be omitted.

In the lid member 42E, the thread 64 is intermittently provided. In the lid member 42E, the thread 64 is not continuous, i.e. is not formed continuously. That is to say, the lid member 42E has a portion where the thread 64 is discontinuous. In Example 5, the air in the space 74 is readily released via a portion formed by cutting out a portion of the thread 64, i.e. a portion where the thread 64 is discontinuous. Example 5 can also achieve the same effects as those achieved in Examples 3 and 4.

Note that the thread 64 in Example 5 is applicable to both the lid member 42A and the lid member 42B. Furthermore, the thread 64 in Example 5 is also applicable to the lid member 42C in Example 3, and the thread 64 in Example 5 is also applicable to the lid member 42D in Example 4. The communicating hole 73 in Example 3 and the slit 75 in Example 4 are also applicable to the lid member 42E in Example 5.

Example 6

Figure 15:
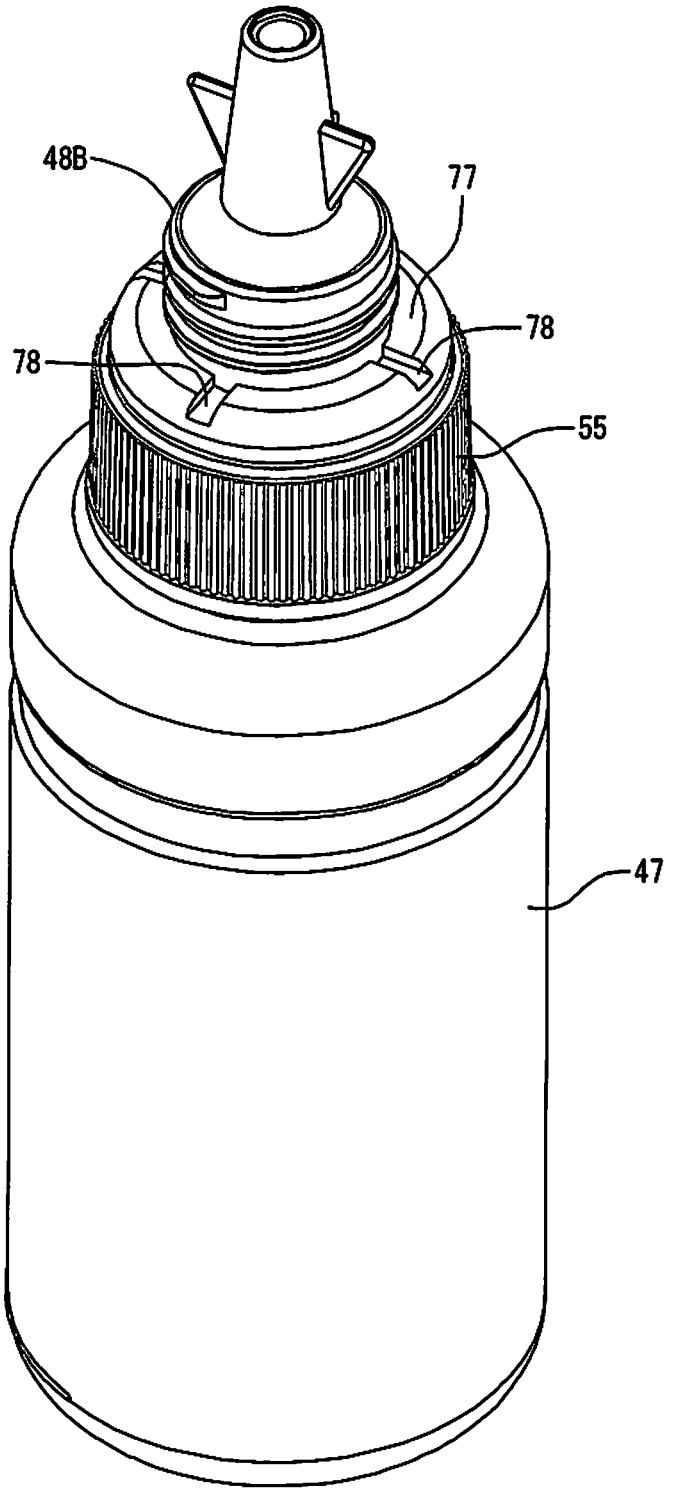
FIG. 15 is a perspective view of a nozzle member and a container member in Example 6.

As an example in which the air in the space 74 can be released, a nozzle member 48B may be employed as shown in FIG. 15. The nozzle member 48B will now be described as Example 6. In Example 6, constituent parts that are the same as those in Examples 1 to 5 will be assigned the same signs as those in Examples 1 to 5, and a detailed description thereof will be omitted.

In the nozzle member 48B in Example 6, grooves 78 are formed at an end 77 of the joint portion 55. The end 77 is a boundary between the joint portion 55 and the nozzle 44, and is located on the nozzle 44 side of the joint portion 55, as shown in FIG. 6. The grooves 78 are formed so as to be recessed from the end 77 toward the container member 47 side, as shown in FIG. 15. In Example 6, even when the end 66 (FIG. 3) of the lid member 42 comes into contact with the end 77 of the nozzle member 48B, gaps are formed between the lid member 42 and the joint portion 55 of the nozzle member 48B by the grooves 78. Thus, the air in the space 74 is readily released via the grooves 78. Example 6 can also achieve the same effects as those achieved in Examples 3 to 5. Note that the nozzle member 48B in Example 6 is applicable to any of Examples 1 to 5. Note that, although a plurality of grooves 78 are provided in this example, the number of grooves 78 may be one.

Example 7

Figure 16:
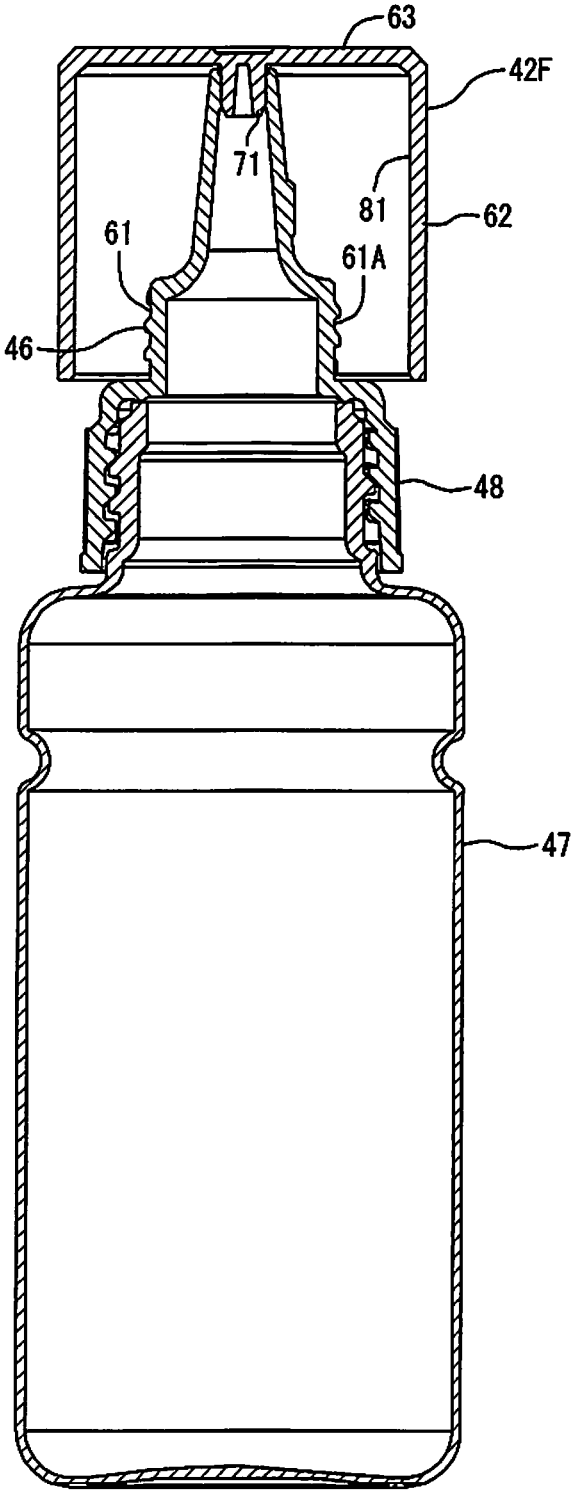
FIG. 16 is a cross-sectional view of a lid member and a bottle in Example 7.

A lid member 42F in Example 7 will now be described. In Example 7, constituent parts that are the same as those in Examples 1 to 6 will be assigned the same signs as those in Examples 1 to 6, and a detailed description thereof will be omitted. In Example 7, a gap is provided between a side face 81 of the barrel 62 of the lid member 42F and a side portion 61A of the engaging portion 61 of the nozzle member 48, as shown in FIG. 16. Note that FIG. 16 shows a cross-section of the lid member 42F taken along the line A-A in FIG. 5. The plug 71 is employed in the lid member 42F. Example 7 provides a configuration in which the inside and the outside of the lid member 42F can be in communication with each other due to the gap between the side face 81 and the side portion 61A. Note that, in the nozzle member 48 in the case of applying the lid member 42F in Example 7, the thread 46 may be omitted.

Example 7 is applicable to various dimensions of the engaging portion 61 within the area of the gap between the side face 81 and the side portion 61A, for example. That is to say, Example 7 is applicable to various nozzle members 48 with engaging portions 61 having different diameters. In Examples 2 to 6, the dimensions and shape of the barrel 62 are set in association with the diameter of the engaging portion 61. That is to say, one type of lid member 42 is required for one type of nozzle member 48. In contrast, in Example 7, one lid member 42F can be used for various nozzle members 48 with engaging portions 61 having different diameters. For this reason, the lid member 42F can be shared by a plurality of types of nozzle members 48, which can reduce the costs of the lid member 42F, and can also reduce the costs of the bottle set 35.

Example 8

Figure 17:
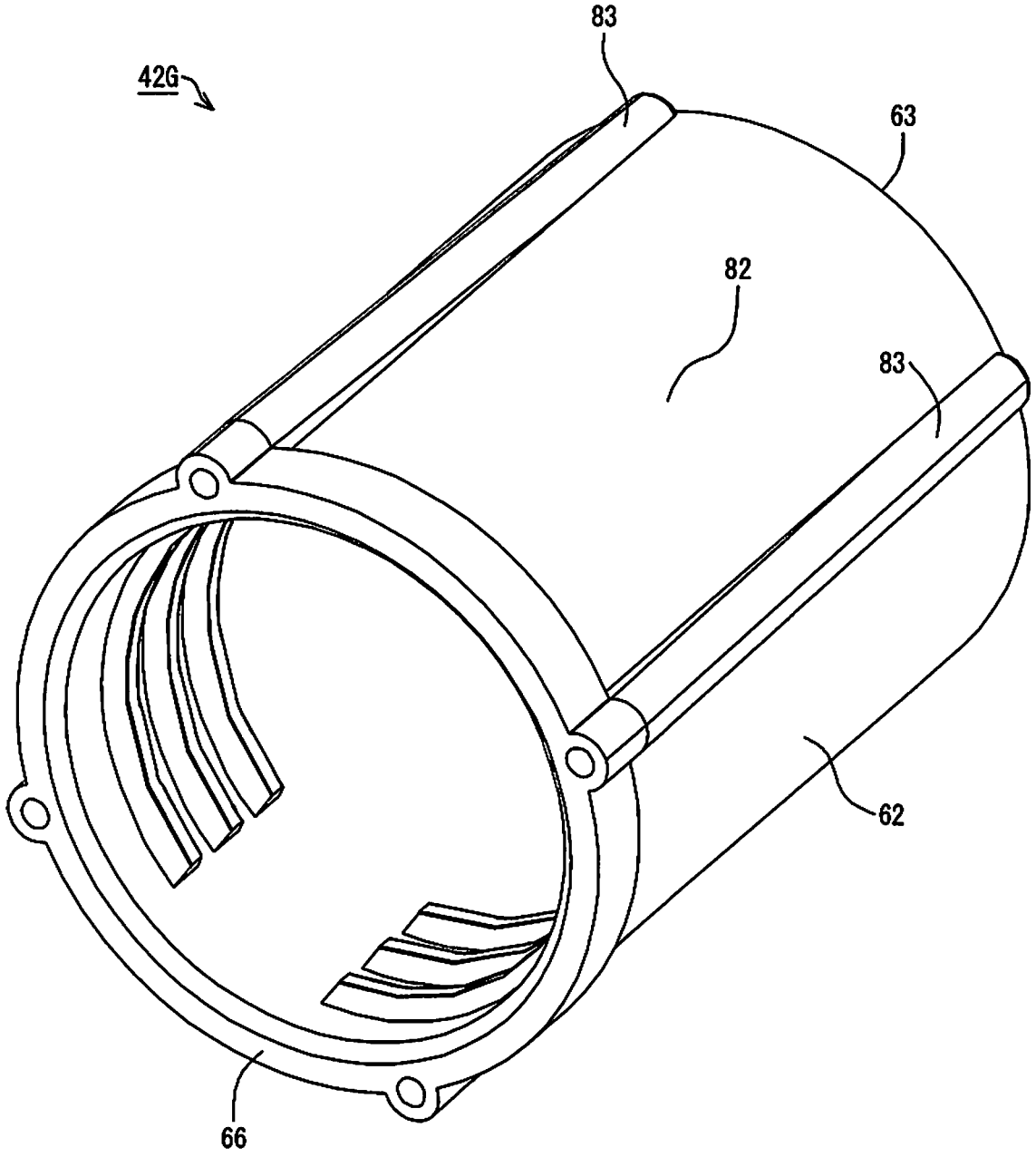
FIG. 17 is a perspective view of a lid member in Example 8.

A lid member 42G in Example 8 will now be described. In Example 8, constituent parts that are the same as those in Examples 1 to 7 will be assigned the same signs as those in Examples 1 to 7, and a detailed description thereof will be omitted. In the lid member 42G, ribs 83, which project outward from the lid member 42G, are provided in an outer peripheral portion 82 of the barrel 62, as shown in FIG. 17. In this example, a plurality of ribs 83 are provided. The ribs 83 project outward of the barrel 62 from the outer peripheral portion 82. The ribs 83 extend from the end 66 of the barrel 62 in a direction toward the top plate 63.

With the lid member 42G in Example 8, when the barrel 62 is placed on a floor or a desk, for example, the ribs 83 are likely to obstruct rolling of the barrel 62 on the surface. In addition, for example, when a user holds the lid member 42G with fingers to turn the lid member 42G, the ribs 83 are easily hooked at the fingers. Thus, the ribs 83 also achieves the effect of slip resistance or a handle. Note that the ribs 83 in Example 8 are applicable to any of Examples 1 to 7.

Figure 18:
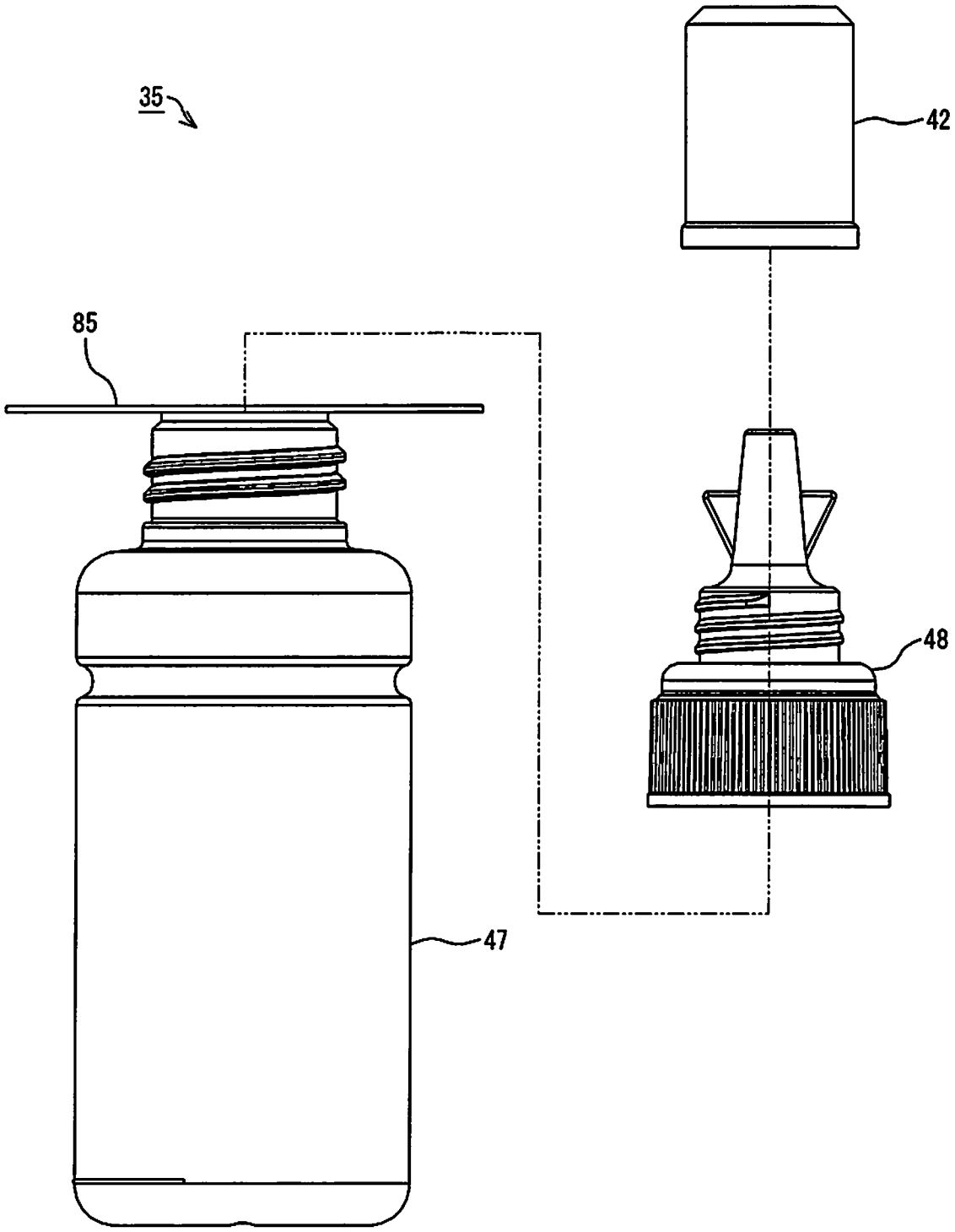
FIG. 18 is an exploded view showing another example of a bottle set according to an embodiment.

The bottle set 35 may also employ a configuration in which a film 85 is added to the container member 47, as shown in FIG. 18. The film 85 has a size and shape that allow the opening 54 to be covered. The film 85 is joined to the end 53B of the opening 54 (FIG. 6). The film 85 is joined to the end 536 by means of adhesion, for example. Thus, a high liquid-tightness is kept in the container member 47, and the ink can be stored in an airtight manner in the container member 47. The user who uses the bottle set 35 removes the film 85 from the container member 47 before injecting the ink in the bottle set 35 into the tank 31, and thereafter injects the ink. The material of the film 85 may be polyethylene terephthalate (PET), nylon, polyethylene, or the like, for example. A laminated structure in which those materials are laminated may also be employed. Furthermore, a configuration that includes a layer of any of those materials to which aluminum or the like is evaporated may also be employed. Thus, higher gas barrier properties can be achieved.

Figure 19:
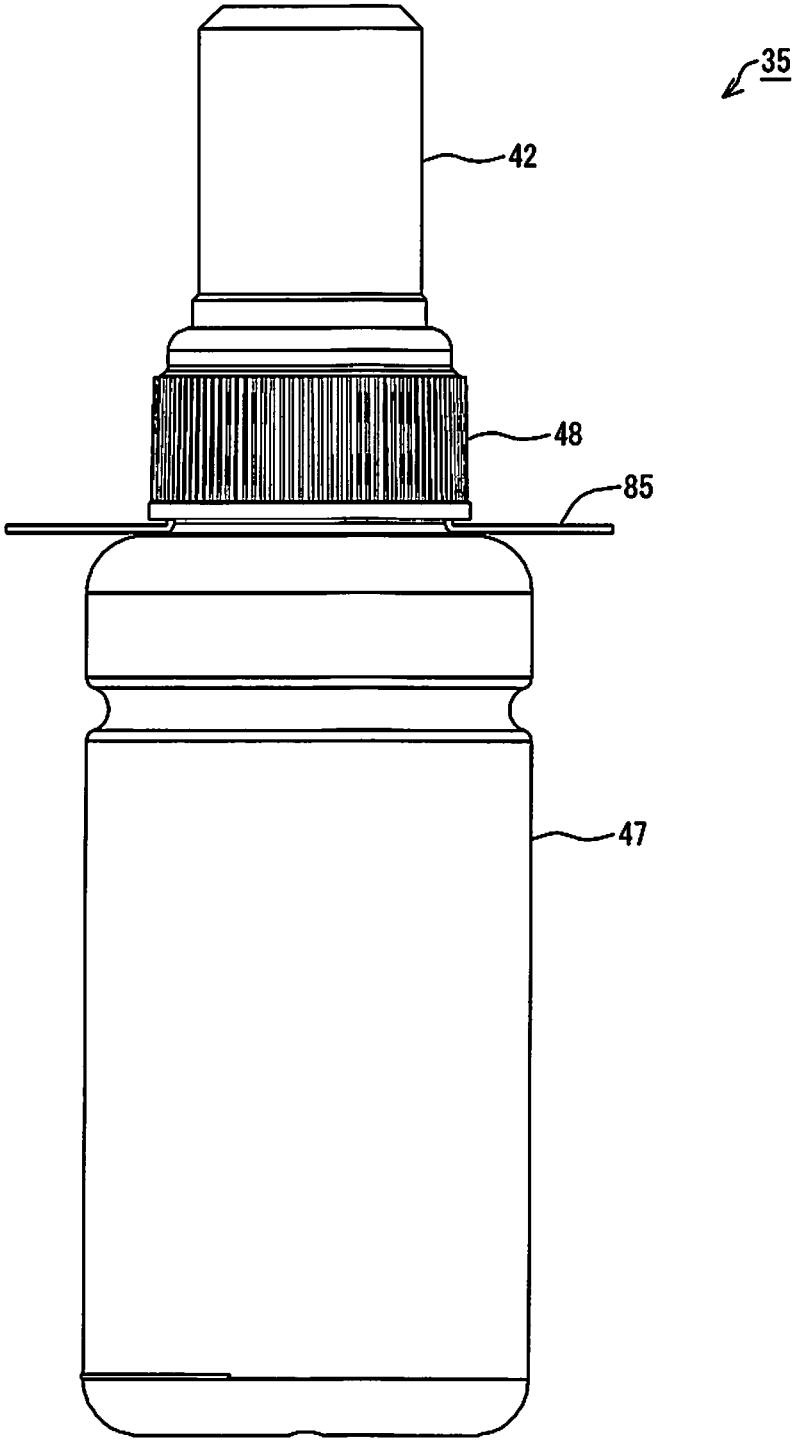
FIG. 19 is an external view showing another example of a bottle set according to an embodiment.

With the bottle set 35 having the film 85, the film 85 can be set to stick out from the nozzle member 48 with the nozzle member 48 attached to the container member 47, as shown in FIG. 19. This is because, if the film 85 sticks out from the nozzle member 48, the user can easily notice the film 85. If the user is not aware of the presence of the film 85, the user tries to inject the ink in the bottle set 35 into the tank 31 but cannot do so, which is inconvenient. This situation makes it difficult to improve the convenience of the bottle set 35.

In contrast, if the film 85 is set to stick out from the nozzle member 48, the user can easily notice the film 85. Thus, the user is readily made to remove the film 85 from the container member 47 before injecting the ink in the bottle set 35 into the tank 31. As a result, it is possible to prompt the user to perform an operation to remove the film 85 from the container member 47 before injecting the ink into the tank 31. Thus, the convenience of the bottle set 35 can be improved.

In addition, if the film 85 is set to stick out from the nozzle member 48, the user can readily hold the film 85. Thus, the film 85 can be readily removed from the container member 47, which further improves the convenience of the bottle set 35. Also, a label can be added to a portion of the film 85 that sticks out from the nozzle member 48. The label may include information regarding the ink, such as ink color and main components thereof, and cautions regarding the handling, for example. Furthermore, color that indicates the ink color may also be added as the information regarding the ink. The label added to the film 85 can further improve the convenience of the bottle set 35. Addition of the label to the film 85 allows the user to more easily notice the film 85. As a result, the convenience of the bottle set 35 can be further improved.

In the above embodiment and examples, the ink ejection apparatus may be a liquid ejection apparatus that ejects, discharges, or applies liquid other than ink to consume the liquid. Note that the status of liquid discharged as very small droplets from the liquid ejection apparatus includes a granular shape, a tear-drop shape, and a shape having a thread-like trailing end. Furthermore, the liquid mentioned here may be any kind of material that can be consumed by the liquid ejection apparatus. For example, the liquid need only be a material whose substance is in the liquid phase, and includes fluids such as inorganic solvent, organic solvent, solution, liquid resin, and liquid metal (metal melt) in the form of a liquid body having a high or low viscosity, sol, gel water, or the like. Furthermore, the liquid is not limited to being a one-state substance, and also includes particles of a functional material made from solid matter, such as pigment or metal particles, that are dissolved, dispersed, or mixed in a solvent. Representative examples of the liquid include ink such as that described in the above embodiment, as well as liquid crystal, and the like. Here, "ink" encompasses general water-based ink and oil-based ink, as well as various types of liquid compositions such as gel ink and hot melt-ink. Specific examples of the liquid ejection apparatus include liquid ejection apparatuses that eject a liquid containing, in the form of dispersion or dissolution, a material such as an electrode material or a color material used in manufacturing or the like of a liquid crystal display, an EL (electroluminescence) display, a surface-emitting display, or a color filter, for example. The liquid ejection apparatus may also be a liquid ejection apparatus that ejects biological organic matter used in manufacturing of a biochip, a liquid ejection apparatus that is used as a precision pipette and ejects a liquid serving as a sample, a textile printing apparatus, a microdispenser, or the like. Furthermore, the liquid ejection apparatus may also be a liquid ejection apparatus that ejects lubricating oil in a pinpoint manner to a precision machine such as a watch or a camera, or a liquid ejection apparatus that ejects a transparent resin liquid such as ultraviolet-cured resin onto a substrate in order to form a micro-hemispherical lens (optical lens) or the like that is used in an optical communication device or the like. Furthermore, the liquid ejection apparatus may be a liquid ejection apparatus that ejects an etchant which is acid, alkaline, or the like, in order to etch a substrate or the like.

According to one embodiment of the disclosure, a bottle set includes: a bottle having an ink container capable of containing ink, and a nozzle through which the ink in the ink container can flow out; and a lid member that is attachable to and detachable from the bottle, and can cover the nozzle in a state where the lid member is attached to the bottle, wherein an outflow port from which the ink in the ink container can flow out is formed in the nozzle, the lid member has a sealing portion that seals the outflow port in a state where the lid member is attached to the bottle, and the sealing portion is integrally formed in the lid member.

In this bottle set, the sealing portion for sealing the outflow port in the nozzle is integrally formed in the lid member. Thus, in this bottle set, the outflow port in the nozzle can be sealed with the lid member. As a result, the number of parts can be reduced compared with a configuration in which the outflow port is sealed with a member other than the lid member.

In the above-described bottle set, the sealing portion is provided as a plate-shaped abutting portion that comes into contact with a periphery of the outflow port to close the outflow port in a state where the lid member is attached to the bottle, and in the lid member, a thickness of the abutting portion is formed to be smaller than a thickness of another part of the lid member.

In this bottle set, the thickness of the abutting portion is smaller than the thickness of the other part of the lid member. Accordingly, the abutting portion readily undergoes elastic deformation when the abutting portion is caused to abut against the periphery of the outflow port. As a result, the abutting portion and the periphery of the outflow port are readily fitted closely to each other, which facilitates increasing the airtightness at the outflow port.

In the above-described bottle set, the sealing portion is provided as a plug that enters the outflow port to close the outflow port in a state where the lid member is attached to the bottle.

In this bottle set, the plug can be inserted into the outflow port when the lid member is attached to the bottle. Thus, the outflow port can be closed by the plug.

The above-described bottle set further including: a communicating portion capable of bringing inside and outside of the lid member into communication with each other in a state where the lid member is attached to the bottle.

In this bottle set, the inside and the outside of the lid member can be in communication with each other in a state where the lid member is attached to the bottle. Thus, a change in the pressure within the lid member can be mitigated.

In the above-described bottle set, the lid member is provided with a thread capable of engaging with the bottle, the lid member is configured to be able to be attached to the bottle through engagement using the thread, and the communicating portion has a shape formed by cutting out a portion of the thread.

In this bottle set, the communicating portion has a shape formed by cutting out a portion of the thread formed in the lid member. The inside and the outside of the lid member can be brought into communication with each other via the portion formed by cutting out a portion of the thread.

In the above-described bottle set, the communicating portion has a shape of a hole that is formed in the lid member and passes through the lid member to bring the inside and the outside thereof into communication with each other.

In this bottle set, the inside and the outside of the lid member can be brought into communication with each other via the hole that passes through the lid member to bring the inside and the outside thereof into communication with each other.

In the above-described bottle set, the communicating portion has a shape of a slit formed in the lid member.

In this bottle set, the inside and the outside of the lid member can be brought into communication with each other via the slit formed in the lid member.

In the above-described bottle set, a rib projecting outward from the lid member is formed in an outer peripheral portion of the lid member.

In this bottle set, the rib formed in the outer peripheral portion of the lid member can make it difficult for the lid member to roll around, for example.

Note that the invention is not limited to the above embodiment and examples, and can be achieved by various configurations without departing from the gist thereof. For example, the technical features in the embodiment and examples that correspond to the technical features in the modes described in the summary of the invention may be replaced or combined as appropriate in order to solve part or the entire foregoing problem, or to achieve some or all of the above-described effects. The technical features that are not described as essential in the specification can be deleted as appropriate.

What is claimed is:

1. A bottle set comprising:

a bottle having an ink container configured to contain ink, a nozzle through which the ink in the ink container is configured to flow out, and a joint portion integrally formed with the nozzle and having a thread configured to engage the nozzle with the ink container; and a lid member that is attachable to and detachable from the bottle, and configured to cover the nozzle in a state where the lid member is attached to the bottle, an outflow port being formed in the nozzle, the outflow port being configured such that the ink in the ink container flows out from the outflow port, the lid member having a tubular barrel, a top plate that closes a barrel end of the tubular barrel, and a plug projecting from the top plate toward the nozzle, a distance from the barrel end of the tubular barrel to a distal end of the plug being shorter than a distance from a nozzle end of the nozzle to the joint portion.

2. The bottle set according to claim 1, wherein the plug enters the outflow port to close the outflow port in a state where the lid member is attached to the bottle.

3. The bottle set according to claim 1, wherein an outer diameter of the plug is greater than an inner diameter of the outflow port.

4. The bottle set according to claim 1, further comprising:

a communicating portion capable of bringing inside and outside of the lid member into communication with each other in a state where the lid member is attached to the bottle.

5. The bottle set according to claim 4, wherein the lid member is provided with a thread configured to engage with the bottle, the lid member is configured to be attached to the bottle through engagement using the thread, and the communicating portion is formed as a non-thread portion intersecting the thread.

6. The bottle set according to claim 4, wherein the communicating portion has a shape of a hole that is formed in the lid member and passes through the lid member to bring the inside and the outside thereof into communication with each other.

7. The bottle set according to claim 4, wherein the communicating portion has a shape of a slit formed in the lid member.

8. The bottle set according to claim 1, wherein a rib projecting outward from the lid member is formed in an outer peripheral portion of the lid member.

9. The bottle set according to claim 1, wherein the bottle comprises a container member including the ink container and an opening portion communicating with the ink container, and the container member includes a film sealing the opening portion in a state where the ink is contained in the ink container.

10. The bottle set according to claim 9, wherein the film has a portion exposed outside of the nozzle in a state where the lid member is attached to the bottle.

* * * * *